US010626689B2

(12) United States Patent
Moyes

(10) Patent No.: US 10,626,689 B2
(45) Date of Patent: Apr. 21, 2020

(54) DOWNHOLE ACTUATOR DEVICE, APPARATUS, SETTING TOOL AND METHODS OF USE

(71) Applicant: XTREME WELL TECHNOLOGY LIMITED, Banchory (GB)

(72) Inventor: Peter Moyes, Banchory (GB)

(73) Assignee: XTREME WELL TECHNOLOGY LIMITED, Banchory (GB)

( * ) Notice: Subject to any disclaimer, the term of this patent is extended or adjusted under 35 U.S.C. 154(b) by 8 days.

(21) Appl. No.: 15/544,123

(22) PCT Filed: Jan. 18, 2016

(86) PCT No.: PCT/GB2016/050103
§ 371 (c)(1),
(2) Date: Jul. 17, 2017

(87) PCT Pub. No.: WO2016/113577
PCT Pub. Date: Jul. 21, 2016

(65) Prior Publication Data

US 2018/0023358 A1 Jan. 25, 2018

(30) Foreign Application Priority Data

Jan. 16, 2015 (GB) ..... 1500758.6

(51) Int. Cl.
*E21B 23/06* (2006.01)
*E21B 34/14* (2006.01)
(Continued)

(52) U.S. Cl.
CPC ..... *E21B 23/06* (2013.01); *E21B 23/00* (2013.01); *E21B 34/06* (2013.01); *E21B 34/14* (2013.01); *E21B 2034/007* (2013.01)

(58) Field of Classification Search
CPC ..... E21B 23/06
(Continued)

(56) References Cited

U.S. PATENT DOCUMENTS 4,898,239 A 2/1990 Rosenthal
5,396,951 A 3/1995 Ross
(Continued)

FOREIGN PATENT DOCUMENTS

WO 2007049046 A1 5/2007
WO 2012150189 A2 11/2012
WO 2013079965 A2 6/2013
WO 2013159237 A1 10/2013
WO 2014170640 A1 10/2014

OTHER PUBLICATIONS

International Search Report and Written Opinion issued in the related PCT Application PCT/GB2016/050103, dated Dec. 6, 2016 (16 pages).

(Continued)

*Primary Examiner* — Taras P Bemko
(74) *Attorney, Agent, or Firm* — Eileen Pape

(57) ABSTRACT

The invention provides an actuator assembly for a downhole tool and a method of use. The actuator assembly comprises an actuator device, which includes a housing and a piston element movable with respect to the housing. First and second fluid paths are configured to couple first and second sides of the piston element to at least one source of fluid pressure in a drive module, and an actuator member is configured to be coupled to a downhole device. The actuator member is movable between a first position and a second position to operate the downhole device in response to a force acting on the piston element. The actuator assembly comprises a pressure release mechanism which is operable to equalise pressure between the first and second fluid paths of the actuator device. The invention may be used in conjunction with a valve module which includes the pres- (Continued)

sure release mechanism, and the valve member preferably comprises a forward flow position, in which a first side of the piston element is pressurised to urge the piston element in a first direction, and a reverse flow position in which a second side of the piston element is pressurised to urge the piston element in a second direction, opposite the first direction. A preferred embodiment of the invention is setting tool incorporating the actuator assembly.

37 Claims, 15 Drawing Sheets

(51) Int. Cl.
*E21B 23/00* (2006.01)
*E21B 34/06* (2006.01)
*E21B 34/00* (2006.01)

(58) Field of Classification Search
USPC ..... 166/373
See application file for complete search history.

(56) References Cited

U.S. PATENT DOCUMENTS

| | | | | |
|---|---|---|---|---|
| 7,913,770 | B2 | 3/2011 | Schramm et al. | |
| 2010/0252252 | A1 | 10/2010 | Harris et al. | |
| 2012/0090858 | A1 | 4/2012 | Ingram et al. | |
| 2012/0261139 | A1 | 10/2012 | Williamson, Jr. et al. | |
| 2013/0133891 | A1* | 5/2013 | Getzlaf | E21B 34/12 166/308.1 |

OTHER PUBLICATIONS

International Preliminary Report on Patentability issued in the related PCT Application PCT/GB2016/050103, dated Jul. 18, 2017 (12 pages).
Combined Search and Examination Report issued in the related GB application 1500758.6, dated May 5, 2015 (7 pages).
Office Action issued in the related EP Application 16706394.0 dated May 9, 2019 (3 pages).

* cited by examiner

DOWNHOLE ACTUATOR DEVICE, APPARATUS, SETTING TOOL AND METHODS OF USE

This application is the U.S. national phase of International Application No. PCT/GB2016/050103 filed Jan. 18, 2016, which designated the U.S. and claims priority to GB Patent Application No. 1500758.6 filed Jan. 16, 2015, the entire contents of each of which are hereby incorporated by reference.

The present invention relates to a downhole actuator device, a downhole tool, and methods of use in hydrocarbon wellbore applications, and in particular to a setting tool for setting and/or releasing a downhole plug or packer and a method of use. Aspects of the invention relate to downhole apparatus including valve modules for setting tool and downhole actuator applications, and downhole assemblies which incorporate a setting tool and/or a valve module.

BACKGROUND TO THE INVENTION

In the field of hydrocarbon exploration and production, it is common to use actuator devices and tools to controllably actuate or operate from surface downhole components and tools between first and second operational conditions. A typical application is the setting and/or releasing of a downhole plug or packer during a wellbore operation. Other applications include but are not limited to setting straddles, whipstocks, and/or cement retainers. A wide range of setting tools have been developed or proposed for use with different drive systems, and many have been used in the field with successful results. The majority of setting tools are hydraulically operated, and use hydraulically actuated pistons to drive a setting mechanism, which is often (but not always) configured to force an outer sleeve downwards with respect to an inner rod or mandrel.

Drive systems used to operate setting tools include gas drive systems, pump drive systems, and hydrostatic pressure drive systems. In a gas drive system, a downhole module is used to generate high pressure gas from a pyrotechnic device, a chemical reaction, or a thermal reaction. The high pressure gas drives the actuator pistons of the setting tool, either by directly acting on the actuator pistons, or by driving a piston down to generate a flow of hydraulic fluid to the actuator pistons. Typical pressures generated from pyrotechnic systems of this type are around 62,000 kPa to 90,000 kPa (around 9,000 psi to 13,000 psi), which is sufficient for many downhole setting applications.

An example of a gas drive setting tool is disclosed in U.S. Pat. No. 5,396,951. A preferred embodiment uses a resistance heater to initiate a pyrotechnic chemical reaction and generate a gas pressure which acts on a primary floating piston. The floating piston acts on hydraulic fluid to pressurise a secondary piston, which in turn transfers a force to a setting sleeve. The described setting tool is said to avoid the requirement for primary and secondary igniters, and is said to enable a single drive module to be assembled, sold and shipped.

Pump drive systems use a combination of a motor and a pumps, which may be located downhole or at surface. Downhole pump drive systems have been developed as an alternative to pyrotechnic drive mechanisms such as that disclosed in U.S. Pat. No. 5,396,951. A downhole pump drive system uses electric current from surface or downhole batteries to drive a motor, which in turn drives a high pressure pump. The pump causes hydraulic fluid to flow to the actuator pistons of the setting tool. A surface pump drive system uses a surface motor and pump to cause fluid to be pumped from surface down drill pipe or coiled tubing to the setting tool system where it acts on the actuator pistons.

Limitations to the pressure capabilities of downhole pumps has led to the use of multistage, stacked piston arrangement with downhole pump drive systems in order to increase the available setting force. More recently, WO2014/170640 describes a non-explosive setting tool which uses high pressure downhole pumps to generate a system pressure of up to around 96,500 kPa (about 14,000 psi) in a single-stage actuation system. The setting tool comprises a downhole motor and pump assembly which is used to pump hydraulic fluid from a first chamber to drive a piston arrangement between an unset and a set position. After use, a plug is opened to enable return of hydraulic fluid from the piston chamber back to the first fluid chamber, ready for reuse.

Hydrostatic drive systems comprise a mechanism configured to open a valve and expose a flow system in the setting tool to hydrostatic pressure. The hydrostatic pressure causes wellbore fluids to enter the flow system and actuate the pistons to operate the tool. Depending on the available hydrostatic pressure, hydrostatic drive systems may use stacked piston arrangements to provide the desired setting force.

An alternative mechanism is disclosed in WO 2012/150189, which describes a setting tool with first and second fluid chambers fluidly connected via first and second channels. Fluid is pumped from the first chamber to the second chamber via the flow channels. The volume of the first chamber is adjusted to maintain an ambient pressure condition in the first chamber while a fixed volume of the second chamber becomes pressurised and charges a spring-loaded piston. A trigger releases a sleeve from an inner mandrel and causes relative movement of the sleeve and the mandrel to a setting position. After use, the pressure in the first and second chamber can be equalised by reversing the pumping direction or through an optional additional flow channel which is open in the fully set position of the tool.

U.S. Pat. No. 7,913,770 describes a setting tool with a porous plug that enables an atmospheric chamber to be equalised to wellbore pressure after actuation of the tool.

While the above-described setting tools may be useful in certain applications, many of these systems have significant drawbacks. Firstly, the use of pyrotechnics in gas drive modules and systems requires special permits and particular safety considerations which complicate operation and logistics.

The use of downhole motors and pump modules addresses these safety issues, but the motors and pumps themselves are often relatively expensive and complex, presenting commercial and technical barriers to their widespread use. Surface pumps and hydrostatic systems may be limited in the available input pressure, and may therefore provide insufficient actuation force for some applications (particular those which require higher setting or release forces). In addition, in hydrostatic applications, fluid levels may be uncertain and therefore the available hydrostatic pressure and actuation force may not be reliably known.

Other drawbacks include the specificity of setting tools to a particular category of drive module (or proprietary drive module), and a fixed force output from the actuator device. Furthermore, typically actuator devices are unidirectional; they can only provide a force one direction. These drawbacks limit the operational efficiency of the tools and increase operational inventory.

In addition, many downhole plug systems rely on the shearing of a solid shear stud or shear ring attached to the plug in order to release the setting tool from the plug at the end of the setting sequence. A consequence of these configurations is that in the event of a failure in the setting tool system, which may result from motor burn out, a damaged piston seal or a gas leak, the setting tool can remain permanently attached to the plug which is partially set in the wellbore. This represents a significant operational problem and in some extreme cases may result in the loss of the well. Furthermore, in some cases, such as a burnt out motor-pump drive system, or an insufficient fluid column when relying on hydrostatic pressure, the partial setting force remains 'trapped' in the tool. This prevents various contingencies that might otherwise be employed (for example, a mechanical release system) from releasing the setting tool from the plug.

SUMMARY OF THE INVENTION

There is generally a need for apparatus and method of use which addresses one or more of the problems identified above. It is amongst the aims and objects of the invention to provide an apparatus and method of use which obviates or mitigates one or more drawbacks or disadvantages of the prior art.

In particular, one aim of an aspect of the invention is to provide an actuator device or actuator assembly which is capable of releasing a setting force or setting pressure, and which may therefore facilitate the removal of a setting tool from a partially set plug or packer.

Another aim of an aspect of an aspect of the invention is to provide an actuator device or actuator assembly which is bidirectional or reversible.

A further aim of an aspect of the invention is to provide an actuator device or actuator assembly suitable for use with a wide range of drive modules.

A further aim of an aspect of the invention is to provide an actuator device or actuator assembly which is modular or stackable, and which therefore enables force output and/or operating pressure to be modified according to application and/or the drive module or methodology employed.

Additional aims of the invention include provide downhole tools incorporating the actuator devices described above, and/or valve modules for use in such downhole tools.

Further aims and objects of the invention will become apparent from the following description.

According to a first aspect of the invention, there is provided an actuator assembly for a downhole tool, the actuator assembly comprising:

an actuator device comprising:

- a housing;
- a piston element movable with respect to the housing;
- first and second fluid paths configured to couple first and second sides of the piston element to at least one source of fluid pressure;
- an actuator member configured to be coupled to a downhole device, the actuator member movable between a first position and a second position to operate the downhole device in response to a force acting on the piston element;

and a pressure release mechanism, wherein the pressure release mechanism is operable to equalise pressure between the first and second fluid paths of the actuator device.

The pressure release mechanism enables pressure on opposing sides of the piston element to be equalised, and renders the piston element free to move under an external force (i.e. it is unimpeded by a pressure differential across the piston element). This may facilitate decoupling or disconnection of the actuator device from the downhole device. Applications include releasing of the actuation device from a partially set downhole plug or packer.

The piston element may be actuable to move with respect to the housing by a pressure acting on the piston element. The piston element may be a hydraulic piston element, or may be a gas (or pneumatic) piston element.

The terms "upper", "lower", "above", "below", "up" and "down" are used herein to indicate relative positions in the wellbore. The invention also has applications in wells that are deviated or horizontal, and when these terms are applied to such wells they may indicate "left", "right" or other relative positions in the context of the orientation of the well.

Preferably, the pressure release mechanism is operable to vent internal pressure in the actuator device. Thus an excess of pressurised fluid may be discharged from the actuator device, which may be an advantage when decoupling or disconnecting the actuator device from a downhole device, and/or if recovering the actuator device to surface.

The pressure release mechanism may be implemented in a valve module, which may be operable to move between a first position in which the first and second fluid paths are isolated from one another and in communication with first and second sides of the piston element, and a second position in which the first and second fluid paths are in fluid communication with one another.

The pressure release mechanism may be actuable from surface, and may be actuable by imparting a mechanical force, such as a pulling force or downweight force on the pressure release mechanism.

The pressure release mechanism may be operable at a point in the movement range of the piston element and/or actuator member between the first position and the second position. Thus the pressure release mechanism may be operable at a point in the movement range of the piston element other than a fully unset or a fully set position, and may be operable throughout the movement range of the piston element and/or actuator member.

The valve module preferably comprises a first sub assembly and a second sub assembly. Preferably, the first sub assembly and second sub assembly are movable between a first position in which the first and second fluid paths are isolated from one another and in communication with first and second sides of the piston element, and a second position in which the first and second fluid paths are in fluid communication with one another.

Preferably, prior to actuation, the first and second sub assemblies are retained in the first position by a releasable connection, which may comprise one or more shearable or frangible components. The one or more shearable or frangible components may comprise one or more shear pins or shear sleeves.

Preferably, the pressure release mechanism comprises a locking mechanism which functions to retain the pressure release mechanism in its second position subsequent to actuation. The locking mechanism may comprise a ratchet. The locking mechanism may be releasable.

Preferably, the actuator assembly comprises a first mode of operation in which a first side of the piston element is pressurised to urge the piston element in a first direction. The actuator assembly may comprise a second mode of operation in which a second side of the piston element is pressurised to urge piston element in a second direction, opposite the first direction.

Preferably, the first and/or second fluid paths may be provided within a rod of a piston element, and may comprise fluid bores formed in a rod of a piston element. The fluid bores may be axially oriented in a rod of the piston element. The fluid bores may comprise at least one fluid bore which is radially offset from a central axis of a rod of the piston element, and/or may comprise at least one fluid bore which is aligned with a central axis of a rod of the piston element.

The fluid paths may comprise an annular flow channel, which may be formed around a central axis of a rod of the piston element. Alternatively, the fluid paths may comprise first and second axially oriented bores which are substantially parallel to one another, and displaced from one another in a radial direction.

Preferably, the actuator device comprises a substantially tubular outer housing comprising an internal volume defining at least one hydraulic fluid chamber, and an inner rod extending through the outer housing and sealed with the outer housing at first and second ends of the outer housing. The piston element may form a part of the inner rod, and may disposed in the internal volume and sealed with an inner surface of the outer housing.

In a preferred embodiment, the inner rod comprises a first fluid path in communication with the internal volume on a first side of the piston element, and a second fluid path in communication with the internal volume on a second opposing side of the piston element.

The first and/or second fluid paths may extend through an inner rod of a piston element, and may comprise first and second openings, the first opening disposed at one end of the inner rod, and the second opening disposed at the second (opposing) end of the inner rod. The first and/or second openings may be oriented longitudinally with respect to the inner rod. The first and/or second openings may be positioned on longitudinal axes which are within the boundary defined by an outer diameter of the inner rod. The first and/or second openings may therefore be positioned in first and/or second end faces of the inner rod.

The first fluid path may be configured to be coupled to a source of fluid pressure in a first mode of operation to pressurise a first side of the piston element and urge the inner rod in a first direction with respect to the outer housing. The second fluid path may be configured to be coupled to a source of fluid pressure in a second mode of operation, to pressurise the second side of the piston element and urge the inner rod in a second direction with respect to the outer housing, opposite the first direction.

Providing fluid paths within the interior of an inner rod of a piston element in the manner of some embodiments of the invention provides certain operational advantages. For example, such a configuration enables exit points for the hydraulic actuation circuit to be formed within the inner rod, rather than in one or more separate fluid paths that are external to the inner rod. This arrangement facilitates provision of an outer housing which is pressure-balanced in use. The outer housing may have first and second ends that have surface areas which are substantially equal (and preferably identical within manufacturing tolerances). Such a configuration may be difficult or impossible to achieve if one or more fluid paths were arranged outside of the inner rod, as in such circumstances it may be necessary to design the outer housing to account for or accommodate the position of one or more of the fluid paths.

Preferably, the actuator assembly comprises a flow direction means, which is operable to configure the actuator assembly in the first mode of operation or the second mode of operation.

Preferably, the flow direction means is implemented in a flow direction valve. The flow direction valve may have a forward flow position, in which a first side of the piston element is pressurised to urge the piston element in a first direction, and a reverse flow position in which a second side of the piston element is pressurised to urge the piston element in a second direction, opposite the first direction.

Preferably the flow direction means is implemented in a valve module, and more preferably the valve module comprises the flow direction means and the pressure release mechanism.

Preferably, the flow direction means defines a flow path between the at least one source of fluid pressure and the first and/or second flow paths. The flow direction means may be configured to be coupled to a drive module, and may define an interface between the drive module and the actuator device. Preferably the flow direction means comprises an inlet for receiving pressurised fluid from a drive module, and a return line for receiving fluid returned from the actuator device. The return line may comprise an outlet, which may be connected to the drive module, or may discharge to an exterior of the flow direction means.

Preferably, the valve module or a component thereof is operable to be moved between its forward flow and reverse flow positions. In one embodiment, the valve module or a component thereof is operable to be rotated with respect to the actuator device to move between its forward flow and reverse flow positions. In another embodiment, the valve module or a component thereof is operable to slide with respect to the actuator device to move between its forward flow and reverse flow positions.

The valve module may be operable to be moved between its forward flow and reverse flow positions when in a downhole location. The valve module may therefore be reconfigured between its forward flow and reverse flow positions without necessarily recovering the device to surface. Alternatively, or in addition, the valve module may be reconfigured between its forward flow and reverse flow positions when at surface, for example prior to or between downhole operations.

The valve module preferably comprises a first sub assembly and a second sub assembly. In one embodiment, the first sub assembly is operable to be rotated with respect to the second sub assembly to move between its forward flow and reverse flow positions. In another embodiment, the first sub assembly is operable to slide with respect to the second sub assembly to move between its forward flow and reverse flow positions.

In some embodiments, the valve module is provided with an alignment mechanism which engages the first and/or second sub assemblies when in a desired relative alignment. Preferably the alignment mechanism is configured to engage the first and/or second sub assemblies when in a first desired relative alignment, which may be the forward flow position, and is configured to engage the first and/or second sub assemblies when in a second desired relative alignment, which may be the reverse flow position. The alignment mechanism may comprise at least one recess and at least one pin. The at least one pin may be configured to engage the recess when in a desired relative alignment. The valve module may comprise one or more visual alignment indicators.

In a preferred embodiment, the valve module comprises a housing sub assembly and a body sub assembly at least partially disposed within the housing. Preferably, the housing sub assembly is configured to be rotated with respect to the body sub assembly between the forward flow position in which the source of fluid pressure is connected to the first fluid path, and a reverse flow position in which the source of fluid pressure is connected to the second fluid path. Preferably, in the first position the second fluid path is connected to the return line. More preferably, in the second positon the first fluid path is connected to the return line.

The housing sub assembly may be configured to be rotated 180 degrees with respect to the body sub assembly between the forward flow and reverse flow positions.

In one embodiment, the housing sub assembly comprises a sleeve. The body sub assembly may comprise a plurality of radial ports. The sleeve may comprise one or more annular recesses, and the annular recesses may be configured to fluidly connect radial ports of housing sub assembly.

The actuator device may comprise at least one actuator module. The actuator device may comprise at least two actuator modules. Preferably an actuator module is configured to be connectable to another actuator module to assemble the actuator device. An actuator module may therefore be stackable with at least one other actuator module to form an actuator device.

Preferably each actuator module comprises a piston element and a housing.

More preferably, each actuator module comprises a substantially tubular outer housing section comprising an internal volume defining at least one hydraulic fluid chamber, and an inner rod section extending through the outer housing and sealed with the outer housing section at first and second ends of the outer housing section. The piston element may form a part of the inner rod section, and may disposed in the internal volume and sealed with an inner surface of the outer housing section.

As noted above, the first and/or second fluid paths may extend through an inner rod of a piston element, and may comprise first and second openings, the first opening disposed at one end of the inner rod, and the second opening disposed at the second (opposing) end of the inner rod. Such a configuration facilitates stacking and/or connecting multiple actuator modules, as their respective inner rods may be connected to one another in a simple manner, while providing fluid communication between the respective first and second fluid path sections defined by each inner rod section.

Each module may be capable of providing an output force within a particular range, depending on the design and particular size of the module. In some embodiments, it may be desirable for an actuator module to have an operating pressure that is within below a particular operating pressure threshold. This threshold may be determined by the available pressure from a preferred drive module, a desired operating pressure due to design, equipment, or material constraints, and/or the pressure range in which readily available pressure test equipment operates. In some embodiments, the maximum operating pressure is selected to be less than around 18,000 psi (about 124,000 kPa), and may be in the region of 15,000 psi (about 103,000 kPa).

The actuator device may comprise a pair of actuator modules. Therefore the actuator device may be capable of delivering an output force of up to twice that of the output force of a single module for the same operating pressure.

Although the invention has general application to the setting and releasing of plugs and packers, the modularity of the invention renders it particularly suitable for applications which require relatively high setting or releasing forces, and/or for tool configurations using a range of different drive modules and methodologies. For example, an embodiment with two modules may have particular application to the setting and/or releasing of radially extendable plugs, anchors and seal arrangements comprising one or more metal extendable segments, of the type described in the applicant's WO2013/0779965. The relatively low operating pressure facilitates use with pyrotechnic gas drive modules and/or downhole pump and motor drive modules, and is still capable of generating the relatively high setting forces required in these applications.

The actuator device may comprise four or more actuator modules. Therefore the actuator device may be capable of delivering an output force of up to four times that of the output force of a single module for the same operating pressure. Such an embodiment may have particular utility with hydrostatic drive modules, which may have lower available input pressure.

Alternative embodiments of the invention may comprise unequal numbers of inner rod sections and outer housing sections. For example, the actuator device may comprise a single inner rod and a plurality of outer housing sections mounted on the inner rod. Alternatively, the device may comprise multiple inner rod sections and an unequal number of outer housing sections (for example two inner rod sections and three outer housing sections of appropriate length and appropriately positioned piston heads).

The actuator assembly may be configured for use with at least one drive module selected from the group consisting of: a downhole motor-pump drive module; a downhole gas drive module; a surface driven pump drive module; a hydrostatic pressure drive module.

According to a second aspect of the invention, there is provided an actuator device for a downhole tool, the actuator device comprising:

a substantially tubular outer housing comprising an internal volume defining at least one hydraulic fluid chamber;

an inner rod extending through the outer housing and sealed with the outer housing at first and second ends of the outer housing;

wherein the inner rod comprises a piston element disposed in the internal volume and sealed with an inner surface of the outer housing;

wherein the inner rod comprises a first fluid line in communication with the internal volume on a first side of the piston element, and a second fluid line in communication with the internal volume on a second opposing side of the piston element;

wherein the first and second fluid lines each comprise a first opening in a first end face of the inner rod and a second opening in a second end face of the inner rod.

Embodiments of the second aspect of the invention may include one or more features of the first aspect of the invention or its embodiments, or vice versa.

According to a third aspect of the invention, there is provided an actuator device for a downhole tool, the actuator device comprising:

a substantially tubular outer housing comprising an internal volume defining at least one hydraulic fluid chamber;

an inner rod extending through the outer housing and sealed with the outer housing at first and second ends of the outer housing;

wherein the inner rod comprises a piston element disposed in the internal volume and sealed with an inner surface of the outer housing;

wherein the inner rod comprises a first fluid line in communication with the internal volume on a first side of the piston element, and a second fluid line in communication with the internal volume on a second opposing side of the piston element;

wherein the first and second fluid lines each comprise a first opening and a second opening, wherein the first and second openings are oriented longitudinally with respect to the inner rod, and are positioned on longitudinal axes which are within a boundary defined by an outer diameter of the inner rod.

Embodiments of the third aspect of the invention may include one or more features of the first or second aspects of the invention or their embodiments, or vice versa.

According to a fourth aspect of the invention, there is provided an actuator device for a downhole tool, the actuator device comprising:

a substantially tubular outer housing comprising an internal volume defining at least one hydraulic fluid chamber;

an inner rod extending through the outer housing and sealed with the outer housing at first and second ends of the outer housing;

wherein the inner rod comprises a piston element disposed in the internal volume and sealed with an inner surface of the outer housing;

wherein the inner rod comprises a first fluid line in communication with the internal volume on a first side of the piston element, and a second fluid line in communication with the internal volume on a second opposing side of the piston element;

wherein the first fluid line is configured to be coupled to a source of fluid pressure in a first mode of operation to pressurise the first side of the piston element and urge the inner rod in a first direction with respect to the outer housing;

and wherein the second fluid line is configured to be coupled to a source of fluid pressure in a second mode of operation, to pressurise the second side of the piston element and urge the inner rod in a second direction with respect to the outer housing, opposite the first direction.

By providing first and second fluid lines in the inner rod, connected respectively to first and second sides of the piston element, the actuation device can be operated in either direction, depending on the relative movement required between the inner rod and the outer sleeve, by reversing a pressure differential between the first and second fluid lines.

Preferably, the first and second fluid lines comprise bores extending longitudinally in the inner rod.

The first and/or second fluid lines may comprise first and second openings, the first opening disposed at one end of the inner rod, and the second opening disposed at the second (opposing) end of the inner rod. The first and/or second openings may be oriented longitudinally with respect to the inner rod. The first and/or second openings may be positioned on longitudinal axes which are within the boundary defined by an outer diameter of the inner rod. The first and/or second openings may therefore be positioned in first and/or second end faces of the inner rod.

Providing fluid paths within the interior of an inner rod of a piston element in the manner of some embodiments enables exit points for the hydraulic actuation circuit to be formed within the inner rod, rather than in one or more separate fluid paths that are external to the inner rod. This arrangement facilitates provision of an outer housing which is pressure-balanced in use, as the outer housing may have first and second ends that have surface areas which are substantially equal (and preferably identical within manufacturing tolerances).

The actuator device may comprise at least one actuator module. The actuator device may comprise at least two actuator modules. Preferably an actuator module is configured to be connectable to another actuator module to assemble the actuator device. An actuator module may therefore be stackable with at least one other actuator module to form an actuator device.

As noted above, the first and/or second fluid lines may extend through an inner rod of a piston element, and may comprise first and second openings, the first opening disposed at one end of the inner rod, and the second opening disposed at the second (opposing) end of the inner rod. Such a configuration facilitates stacking and/or connecting multiple actuator modules, as their respective inner rods may be connected to one another in a simple manner, while providing fluid communication between the respective first and second fluid line sections defined by each inner rod section.

Embodiments of the fourth aspect of the invention may include one or more features of the first to third aspects of the invention or their embodiments, or vice versa.

According to a fifth aspect of the invention, there is provided an actuator device for a downhole tool, the actuator device comprising:

a housing;

a piston element movable with respect to the housing;

first and second fluid paths configured to couple first and second sides of the piston element to at least one source of fluid pressure via a drive module;

an actuator member configured to be coupled to a downhole device, the actuator member movable between a first position and a second position to operate the downhole device in response to a force acting on the piston element;

wherein the actuator device is compatible with at least two drive modules selected from the group consisting of: a downhole motor-pump drive module; a downhole gas drive module; a surface driven pump drive module; a hydrostatic pressure drive module.

The actuator device may comprise at least one actuator module, and preferably comprises at least two actuator modules. Preferably an actuator module is configured to be connectable to another actuator module to assemble the actuator device.

Preferably each actuator module comprises a piston element and a housing.

Embodiments of the fifth aspect of the invention may include one or more features of the first to fourth aspects of the invention or their embodiments, or vice versa.

According to a sixth aspect of the invention, there is provided a downhole tool comprising:

a drive module; and an actuator assembly according to the first aspect of the invention.

Preferably the downhole tool is a setting tool. Alternatively, or in addition, the downhole tool may be releasing or retrieval tool.

Alternatively, the downhole tool is a punch communication tool.

Embodiments of the sixth aspect of the invention may include one or more features of the first to fifth aspects of the invention or their embodiments, or vice versa.

According to a seventh aspect of the invention, there is provided a downhole tool comprising:

a drive module; and an actuator device according to the second, third, fourth or fifth aspects of the invention.

Preferably the downhole tool is a setting tool. Alternatively, or in addition, the downhole tool may be releasing or retrieval tool.

Alternatively, the downhole tool is a punch communication tool.

Embodiments of the seventh aspect of the invention may include one or more features of the first to sixth aspects of the invention or their embodiments, or vice versa.

According to an eighth aspect of the invention, there is provided a downhole assembly comprising a setting tool according to the fourth or fifth aspects of the invention, and a downhole apparatus connected to the downhole tool.

Preferably the downhole apparatus functions to form a plug, a seal, a flow restriction, a support structure, or an anchor in a wellbore. The downhole apparatus may be selected from the group comprising a bridge plug, a straddle, an anchor, or a wellbore packer.

Preferably, the downhole apparatus comprises one or more segments defining an extendable structure, which may be at least partially formed from a metal tubular, and may comprise a metal tubular and an elastomeric material.

Embodiments of the eighth aspect of the invention may include one or more features of the first to seventh aspects of the invention or their embodiments, or vice versa.

According to a ninth aspect of the invention, there is provided a valve module for a downhole tool, the valve module comprising:

a first housing sub assembly and a second body sub assembly;

wherein the valve module is configured to be connected between a downhole actuator device comprising a piston element, and a drive module for the downhole actuator device;

and wherein the valve module is configured to be connected to first and second fluid bores of the downhole actuator device;

wherein the first housing sub assembly and a second body sub assembly are operable to be moved between a first condition in which the first and second fluid bores of the actuator device are isolated from one another, and a second condition in which the first and second fluid bores are in fluid communication with one another to equalise pressure between the first and second fluid bores.

The valve module may comprise an inlet for receiving pressurised fluid from a drive module, and a return line for receiving fluid returned from the actuator device.

Preferably, the valve module comprises:

a forward flow position, which defines a first flow path between a source of fluid pressure in the drive module and a first bore of actuator device, and a return flow path between a second bore of the actuator device and the return line; and a reverse flow position which defines a second flow path between the source of fluid pressure in the drive module and the second bore of actuator device, and a return flow path between the first bore of the actuator device and the return line.

Embodiments of the ninth aspect of the invention may include one or more features of the first to eighth aspects of the invention or their embodiments, or vice versa.

According to a tenth aspect of the invention, there is provided a method of operating an actuator device of a downhole tool, the method comprising:

providing an actuator device comprising:

a housing; a piston element, and first and second fluid paths coupled to first and second sides of the piston element to at least one source of fluid pressure; and an actuator member coupled to a downhole device;

the method comprising:

moving the actuator member between a first position and a second position in response to a force acting on the piston element to actuate the downhole device; and operating a pressure release mechanism to equalise pressure between the first and second fluid paths of the actuator device.

The method may comprise pressurising a first side of the piston element via the first fluid line, and directing return fluid from the second side of the piston element via the second fluid line.

The method may comprise coupling the first fluid line to a source of fluid pressure in a first mode of operation to pressurise the first side of the piston element and urge the inner rod in a first direction with respect to the outer housing.

The method may comprise coupling the second fluid line to a source of fluid pressure in a second mode of operation, to pressurise the second side of the piston element and urge the inner rod in a second direction with respect to the outer housing, opposite the first direction.

Embodiments of the tenth aspect of the invention may include one or more features of the first to ninth aspects of the invention or their embodiments, or vice versa.

According to an eleventh aspect of the invention, there is provided a method of operating an actuator device of a downhole tool, the method comprising:

providing an actuator device comprising:

a housing; a substantially tubular outer housing comprising an internal volume defining at least one hydraulic fluid chamber;

an inner rod extending through the outer housing and sealed with the outer housing at first and second ends of the outer housing;

wherein the inner rod comprises a piston element disposed in the internal volume and sealed with an inner surface of the outer housing; a first fluid line in communication with the internal volume on a first side of the piston element; and a second fluid line in communication with the internal volume on a second opposing side of the piston element; wherein the method comprises:

pressurising a first side of the piston element via the first fluid line, and directing return fluid from the second side of the piston element via the second fluid line.

The method may comprise coupling the first fluid line to a source of fluid pressure in a first mode of operation to pressurise the first side of the piston element and urge the inner rod in a first direction with respect to the outer housing.

The method may comprise coupling the second fluid line to a source of fluid pressure in a second mode of operation, to pressurise the second side of the piston element and urge the inner rod in a second direction with respect to the outer housing, opposite the first direction.

The method may comprise operating a pressure release mechanism to equalise pressure between the first and second fluid paths of the actuator device.

The first and second fluid lines may each comprise a first opening and a second opening. The first opening may be in a first end face of the inner rod and the second opening may be in a second end face of the inner rod.

The first and second openings may be oriented longitudinally with respect to the inner rod, and may be positioned on longitudinal axes which are within a boundary defined by an outer diameter of the inner rod.

Embodiments of the eleventh aspect of the invention may include one or more features of the first to tenth aspects of the invention or their embodiments, or vice versa.

According to a twelfth aspect of the invention, there is provided a method of operating a downhole actuator device, the method comprising:

providing a valve module comprising a first housing sub assembly and a second body sub assembly, the valve module connected between a downhole actuator device comprising a piston element, and a drive module for the downhole actuator device;

wherein the valve module is connected to first and second fluid bores of the downhole actuator device;

wherein the method comprises:

moving the first housing sub assembly and the second body sub assembly between a first condition in which the first and second fluid bores of the actuator device are isolated from one another, and a second condition in which the first and second fluid bores are in fluid communication with one another; and equalising pressure between the first and second fluid bores.

Embodiments of the twelfth aspect of the invention may include one or more features of the first to tenth aspects of the invention or their embodiments, or vice versa.

According to a further aspect of the invention, there is provided an actuator device substantially as described herein with reference to FIGS. 1 to 4.

According to a further aspect of the invention, there is provided a downhole tool substantially as described herein with reference to FIGS. 5 and 6; 7 and 8; 9 and 10; or 11 and 12.

According to a further aspect of the invention, there is provided a valve module substantially as described herein with reference to FIG. 13 to 15; 16; or 17.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Referring firstly to FIGS. 1A, 1B, 2 and 3, there is shown a downhole tool in accordance with a first embodiment of the invention. The downhole tool, generally depicted at 100, is a setting tool configured for the setting and/or releasing of a downhole plug or packer during a wellbore operation. It will be understood that this implementation of the principles of the invention in a setting tool is merely an example, and other applications of the invention are also envisaged as will be described below.

Figure 1A:
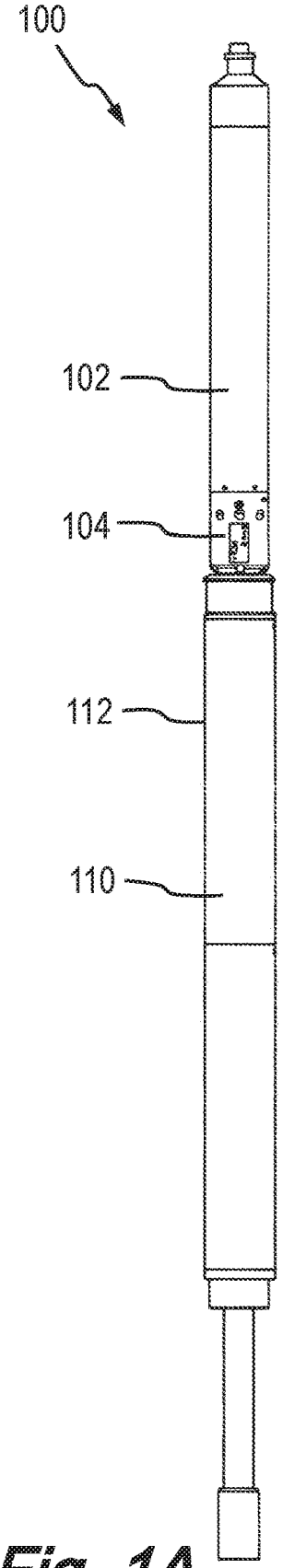
FIG. 1A is an elevation of a downhole tool according to the first embodiment of the invention.

FIG. 1A is an elevation of the downhole tool, which consists of drive module 102 and actuator device 110, and an interface 104 between the drive module 102 and the actuator device 110. It is a feature of the invention that a variety of techniques and equipment can be used to drive the actuator device 110 to operate the downhole tool, and therefore the drive module 102 may comprise internal downhole drive components (not shown), or may be functionally connected to drive components (not shown) located remotely from the tool, for example at surface.

Figure 1B:
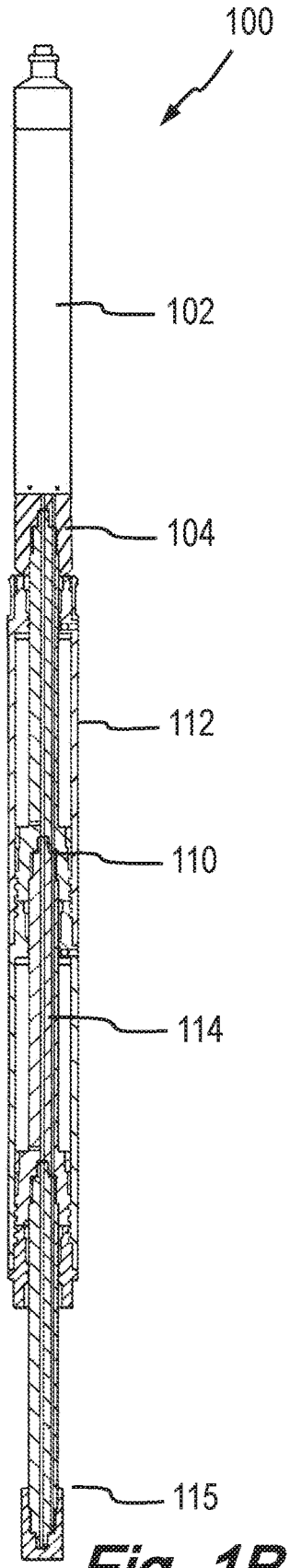
FIG. 1B is a part-sectional view of the downhole tool in FIG. 1A.

FIG. 1B is a part-sectional view of the downhole tool 100. The actuator device 110 and its interface 104 to the drive module 102 are shown in section, with the drive module 102 shown in external elevation.

The downhole tool 100 is substantially cylindrical in form. The downhole tool may be conveyed by a flexible conveyance such as electric line or slick line, or may be conveyed on coiled tubing or drill pipe, depending on the application and the configuration of the drive module 102. An upper end 103 of the drive module 102 has a connector for connecting the tool into its wellbore conveyance.

Figure 2:
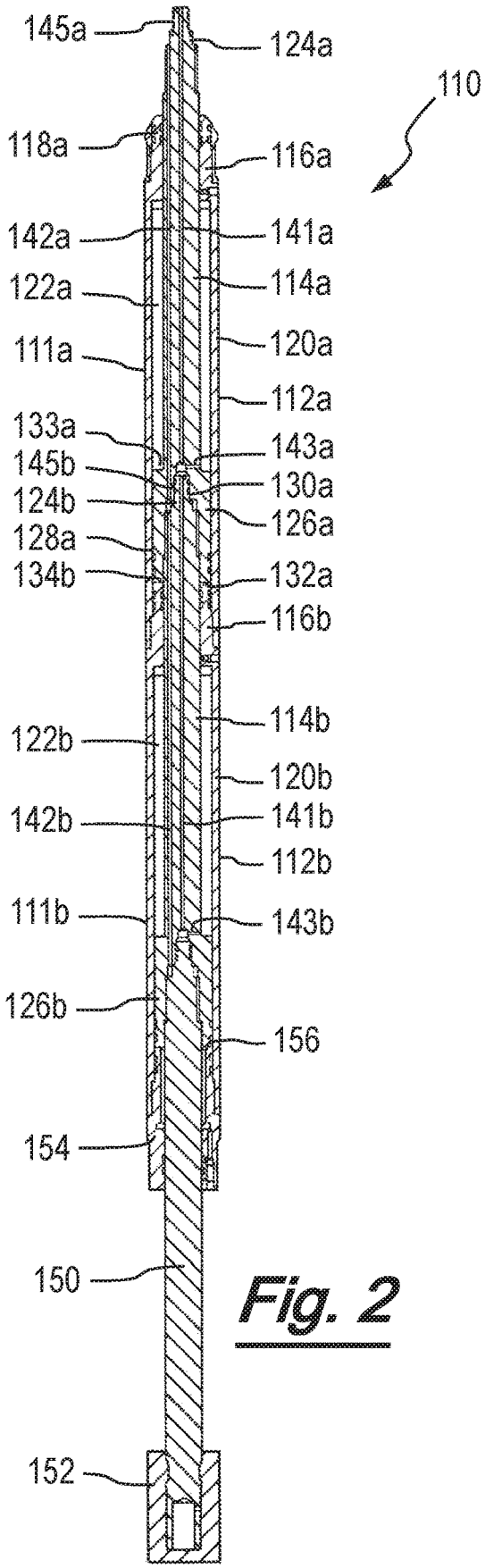
FIGS. 2 and 3 are sectional views of an actuator device of the downhole tool of FIGS. 1A and 1B, shown respectively in first and second conditions.

The actuator device 110 comprises a substantially cylindrical outer housing 112 disposed around an inner rod 114. A lower end 115 of the inner rod 114 extends beyond the axial length of the outer housing 112, and is configured to be coupled to a downhole plug or packer which is to be set (not shown). The outer housing 112 is configured to be moveable with respect to the inner rod 114 between a first (unset or run-in) position is shown in FIGS. 1 and 2, and a second (set or pulling) position shown in FIG. 3. Relative displacement of the housing 112 with respect to the rod 114 mechanically sets and/or releases the downhole packer or plug in use.

The operation of setting and/or releasing a plug or packer by relative movement of a housing and inner rod is known will be familiar to one skilled in the art. However, the principles and details of the actuator device 110 and its interface with the drive module 102 are novel and inventive over the prior art, as will be described in detail below.

Figure 3:
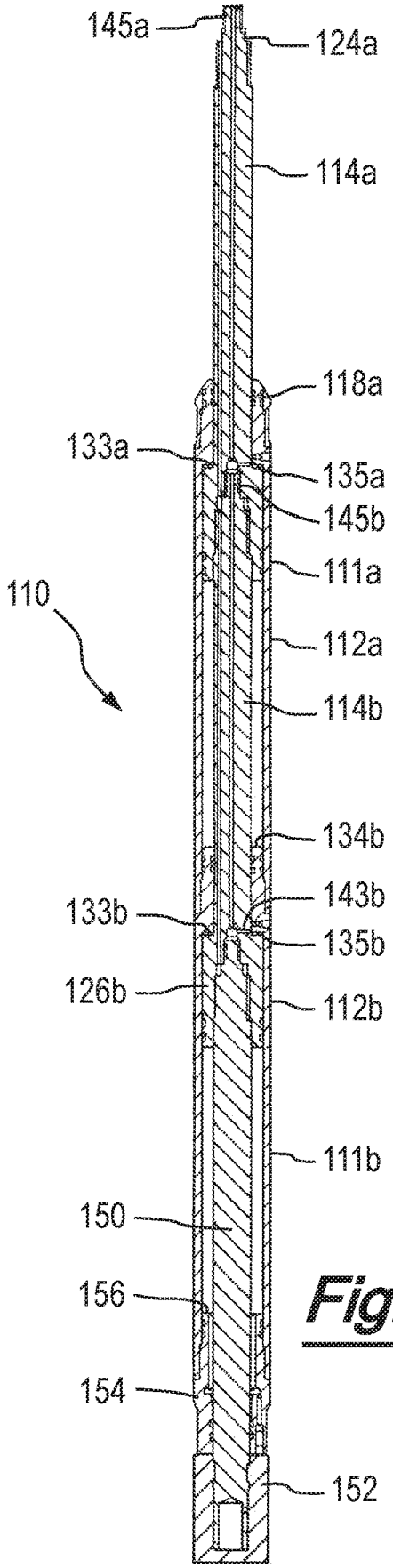
Figure 4:
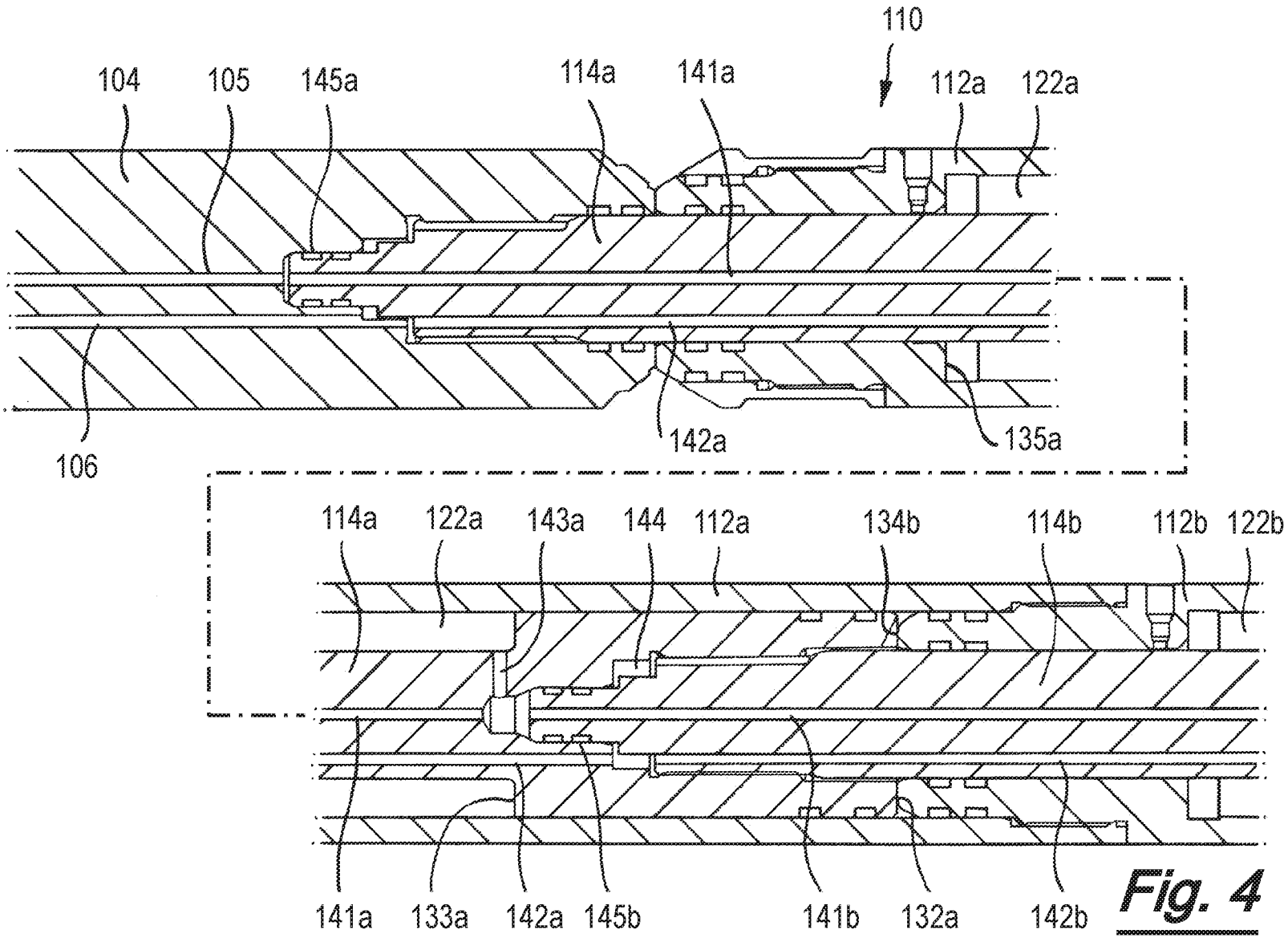
FIG. 4 is an enlarged sectional view of internal features of the apparatus of FIGS. 1A and 1B.

The actuator device 110 is shown most clearly in FIGS. 2, 3 and 4. The actuator device 110 of this embodiment is configured as a dual-stage device, comprising two actuation modules 111*a* and 111*b*, axially stacked to operate together during use. Each actuation module 111*a*, 111*b* comprises a respective inner rod section 114*a*, 114*b* and a respective outer housing section 112*a*, 112*b*.

The uppermost outer housing 112*a* is substantially cylindrical and defines a throughbore sized and shaped to receive inner rod section 114*a*. An upper end of the outer housing section 112*a* comprises an upper bore portion 116*a*, with which the inner rod section 112*a* is sealed by elastomeric o-rings 118*a*. The majority of the length of the outer housing section 112*a* defines an enlarged bore portion 120*a* which, when assembled with the inner rod section 114*a*, defines an annular chamber 122*a* between the inner surface of the housing section and the outer surface of the inner rod. The annular chamber 122*a* functions as a hydraulic chamber in use as will be described below. A lower end of the outer housing section 112*a* has a profiled inner surface which is arranged to correspond with and couple to an upper end of an adjacent outer housing section 112*b*, enabling multiple outer housing sections to be stacked together in a modular fashion.

The inner rod section 114*a* is substantially cylindrical and extends from an upper end to a lower end. The majority of the length of the inner rod section 114*a* is formed to an outer diameter which corresponds to the inner diameter of the upper bore portion 116*a*, so that the rod is spaced from the inner diameter of the housing to define the chamber 122*a*. An upper end of the inner rod section 114*a* comprises a male connector 124*a* which is received in a corresponding recess of the drive module interface 104. A lower end of the inner rod section 114*a* comprises an enlarged mandrel portion 126*a*, which has an outer diameter corresponding to the inner diameter of the enlarged bore portion 120*a*. Elastomeric o-rings 128*a* create a seal between the mandrel portion 126*a* and the outer housing 114*a*. A lower surface of the mandrel portion 126*a* defines a shoulder 132*a* which abuts an upper shoulder 134*b* of the adjacent outer housing section 112*b*. The mandrel portion 126*a* also defines a recess 130*a* for receiving the upper end of an adjacent inner rod section 114*b*, enabling multiple inner rod sections to be stacked together in a modular fashion.

The inner rod section 114*a* comprises a pair of bores 141*a*, 142*a* extending axially through the inner rod section from its first end to its second end.

The first bore 142*a* in this embodiment is offset gun-drilled bore extending from an upper end of the inner rod section to its lower end at a position radially offset from the second bore 141*a*. The first bore extends directly through the inner rod section, and has no communication with the annular chamber 122*a*. The first bore 142*a* is in fluid communication with the first bore 142*b* of the adjacent inner rod section.

In this embodiment, the second bore 141*a* is concentric with the inner rod section and extends from its upper end to its lower end. A radial bore 143*a* links the second bore 141*a* with the annular chamber 122*a* disposed between the inner rod section and the outer housing section. The second bore 141*a* is in fluid communication with the second bore 141*b* of the adjacent inner rod section 114*b*.

The provision of the first and/or second bores extending through the inner rod sections facilitates stacking and/or connecting multiple actuator modules, as their respective inner rods may be connected to one another in a simple manner, while providing fluid communication between the respective first and second fluid bore portions defined by each inner rod section.

Elastomeric o-rings 145*a* are disposed between the openings of the first and second bores, so that when the inner rod section is received in the drive module interface 104, the openings of the bores 141*a*, 141*b* are isolated from one another. When the inner rod section 114*a* is connected with a male connector of an adjacent rod section, the lower openings of the first and second bores are isolated from one another by elastomeric o-ring seals (145*b* on rod section 114*b*).

The second bore 141*b* is isolated from the first bore but is in fluid communication with the lower end of the inner rod section via the annulus (or micro-annulus) 144 between the inner surface of the recess 130*a* and the male connector portion 124*b* of the adjacent inner rod 114*b*). The first bore 142*a* is therefore in fluid communication with the shoulder 134*b* of the adjacent outer housing section 112*b*, and the shoulder 132*a* of the inner rod section.

The second module 111*b* is similar to first module 111*a*, with like parts identified with like reference numerals. The outer housing section 112*b* and the inner rod section 114*b* together define a second annular chamber 122*b* in communication with the second bore 141*b*. The lower end of the inner rod section 114*b* is connected to a lower rod extension member 150, which in turn is connected to a rod termination sub 152. The lower rod extension member 150 extends through and is sealed with a housing termination sub 154. The housing termination sub 154 is joined to and sealed against the lower end of the outer housing section 114*b*, and defines a shoulder 156 which abuts the lower end of the lower rod section 114*b* in the position shown in FIG. 2. Apertures are provided in the outer housing, and extend through the outer housing to the inner rod to accommodate shear pins (not shown).

The basic principles of operation will now be described with reference to FIG. 4. The drive module 102 may be of a range of different drive modules as noted above, and is coupled to the actuator device 110 to selectively provide pressurised fluid to the first and second interface bores 105, 106. In the first operative condition, shown in FIG. 2, fluid is pressurised in the second bore 106, and is a relatively low pressure in the first interface bore 105. High pressure hydraulic fluid is present in the second bore 142 throughout the first and second inner rod sections 114*a* and 114*b*. Relatively low pressure fluid is present in the second bore 141 and annular chambers 122*a*, 122*b*.

The fluid pressure in the first bore acts on the shoulders 134*b* and 156 defined by the upper end of the lower outer housing section 112*b* and the housing termination sub 154. The shoulders define a piston face which generates a net force on the outer housing 112 relative to the inner rod 114. When the force on the outer housing is sufficient to shear the pins in the apertures, the outer housing 112 slides along the inner rod assembly towards a lower setting position, shown in FIG. 3. During movement of the outer housing 112, the volume of the annular chambers 122*a*, 122*b* is contracted and the hydraulic fluid is returned to the drive module 102 via the second bore 141. When the housing termination sub 154 abuts the rod termination sub 152, the device is in the required position to complete the setting of the plug or packer, as shown in FIG. 3.

The downhole tool 110 can also be operated in a reverse mode as follows. With the pressure application from the drive module 102 inverted, the first interface bore 105 is pressurised relative to the second interface bore 106. High pressure fluid is therefore provided to the contracted annular chambers 122*a*, 122*b*, and acts between the piston faces defined by the upper shoulders 133*a*, 133*b* of the inner rod sections and the lower shoulders 135*a*, 135*b* of the outer housing sections 112*a*. The pressure differential causes a net force on the housing assembly 112, and as a consequence, the outer housing 112 moves upwards relative to the inner rod to the position shown in FIGS. 1 and 2. The downhole tool may therefore be used to release or unset a plug or packer, by upward movement of a setting mechanism (not shown) coupled to the outer housing 112. This is a significant benefit over those prior art setting tools which are only capable of operating in one direction to set a downhole packer or plug.

During operation of the downhole tool 100 in a wellbore environment, both the upper and lower end faces of the outer housing 112 are exposed to wellbore pressure. The outer housing has first and second ends with surface areas that are identical within manufacturing tolerances. The outer housing 112 is therefore pressure balanced, and movement of the outer housing 112 on the inner rod does not need to act against hydrostatic pressure in the wellbore. All of the hydraulic energy input to the system is therefore available to drive the actuator device 110 and the setting/releasing mechanism. This is an advantage over those prior art setting tools which must act against hydrostatic pressure and apply sufficient force to actuate the setting mechanism. The pressure-balanced condition of the outer housing is facilitated by the provision of fluid paths and their exit points within the interior of the inner rods. Such a configuration may be difficult or impossible to achieve if one or more fluid paths were arranged outside of the inner rod, as in such circumstances it may be necessary to design the outer housing to account for or accommodate the position of one or more of the fluid paths.

It will be appreciate that during the above-described operation of the tool 100, hydraulic fluid is recirculated in the tool: forward operation of the pistons moves hydraulic fluid from a first volume (or volumes) on a first side of a piston element to a volume on a second side of the piston elements, and reverse operation moves the hydraulic fluid back to the first volume. Therefore the majority of the hydraulic fluid is contained within the actuator device itself, and circulated between opposing sides of the piston. This mitigates the requirement for additional, separate, hydraulic fluid reservoirs, which may otherwise by required at axially separated positions on the tool. (In this regard it should be noted that the reservoir 167 functions to provide capacity for thermal expansion, not to provide the hydraulic fluid as such). Reducing or eliminating the requirement for additional reservoirs has the benefits of reducing required tool length and reducing fluid path lengths.

The dual stage configuration of the actuation mechanism 110 enables the force applied to each piston module to be utilised in the setting or releasing operations without increasing the operating pressure of the hydraulic system. In this example, each actuator module is capable of generating a force of the order of 52,000 lbf (about 231,000 Newtons) for an operating pressure of the order of 15,000 psi (about 103,000 kPa). Therefore, the dual stage actuator device of FIGS. 1 to 4 is capable of delivering a setting or releasing force of the order of 104,000 lbf (about 463,000 Newtons) at the same operating pressure of 15,000 psi (about 103,000 kPa). This configuration enables very high forces to be generated without increasing operating pressures to levels which would significantly increase the pressure rating of equipment used. Increasing the operating pressure of the equipment beyond around 15,000 psi may be undesirable in many applications. The high operating pressures increase technical and operational risk, and high pressure rated equipment generally requires upgrading of material selection and/or design parameters and may therefore be undesirable.

The increase in available setting and releasing force facilitates the application of the actuator device to the setting and releasing of metal-to-metal plugs and seals and hybrid metal-elastomer seals which use an actuation force to deform or otherwise reshape bellows or tubular components for radial displacement. Examples of such applications are described in WO 2013/079965. It is common for plugs of these types to require setting forces up to and around 150,000 lbf (about 670,000 Newtons), and therefore the required force can be generated using two actuator modules in a dual stage set up, as shown in FIGS. 1 to 3.

The principles of the invention do of course apply to other configurations of the actuator device. For example, where lower setting forces are required, or where higher input pressure is available (and is technically and operationally acceptable), a single stage actuator device comprising a single outer housing section and a single inner rod section may be used. In such a configuration, the inner rod section would be connected directly to a rod extension member. The outer housing section would be terminated by a housing termination sub, through which the rod extension member would extend. The operating principles described in relation to the dual stage actuator device of FIGS. 1 to 4 would apply in the same way to provide a single stage reversible setting and releasing actuator device.

Alternatively, the actuator device may comprise two or more outer housing sections on a single inner rod. Such a configuration made up with two outer housing sections would resemble the tool 100, and its form and function will be understood from the foregoing description. However, the device would comprise a single inner rod with first and second piston heads in place of the assembled first and second rod sections. Each outer housing section would extend over a part of the length of the inner rod, and provide multiple piston faces for the relative movement of the outer housing under hydraulic pressure. More than two outer housing sections may be used on a single inner rod, and it will be appreciated that multiple inner rod sections may also be used with an unequal number of outer housing sections (for example two inner rod sections and three outer housing sections of appropriate length and appropriately positioned piston heads).

Similarly, device configurations may be used with additional actuator modules, and the modular nature of the outer housing and inner rod sections facilitate stacking of multiple stages using multiple housing sections and inner rods which are identical in form. Additional modules may be desirable where a higher setting or releasing force is required, or conversely, where a lower system pressure is available. An increased number of modules may also be used as a design choice, where it is desirable to reduce the operating pressure for a given output force for technical or commercial reasons.

As noted above, the actuator device of the present invention is suitable for use with a range of different drive modules and methodologies, and the embodiments described with reference to FIGS. 1 to 4 are not specific to a particular type of drive module. There will now be described various embodiments of the invention in context of specific drive modules.

Figure 5A:
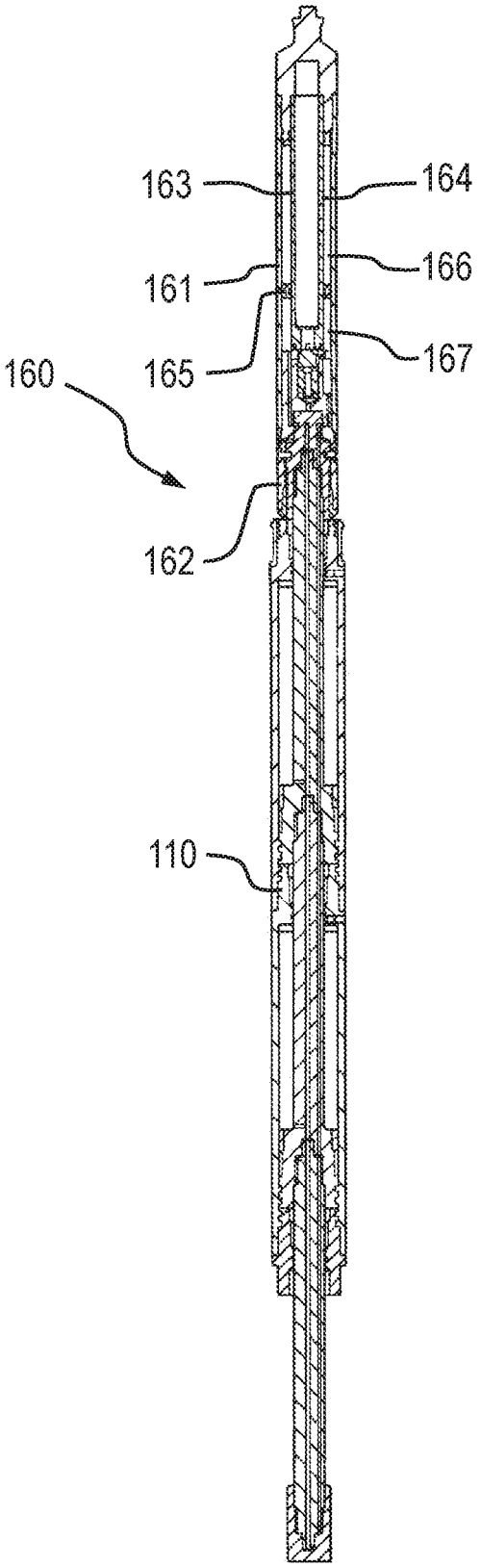
FIG. 5A is a longitudinal sectional view of a downhole tool according to an embodiment of the invention, configured for use with a motor pump drive module.
Figure 5B:
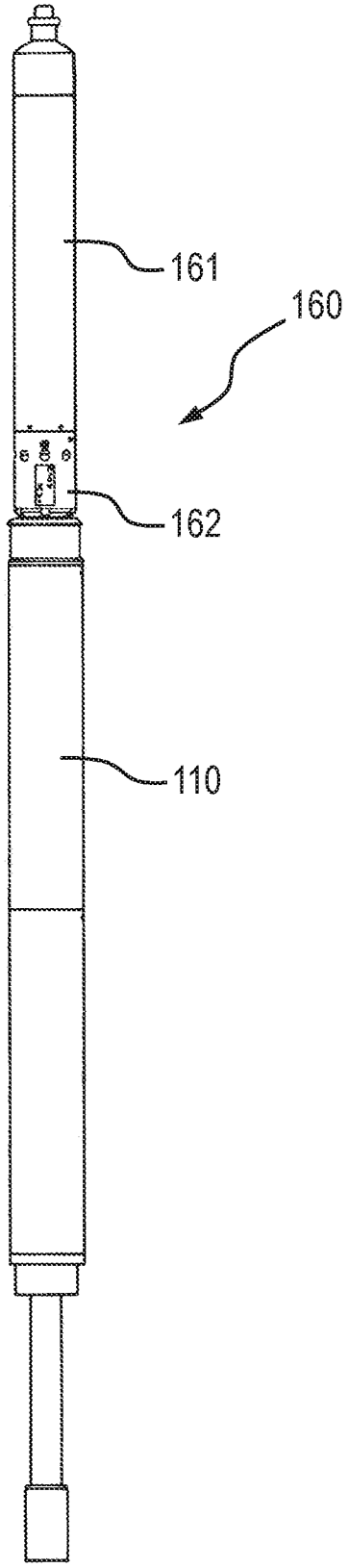
FIG. 5B is an elevation of the downhole tool of FIG. 5A.

Referring to FIGS. 5A and 5B, there is shown a downhole tool according to an alternative embodiment of the invention. The downhole tool, generally depicted at 160, is shown in FIG. 5A in longitudinal section view and in FIG. 5B from a side view. The tool 160 is similar to the tool 100, and its features and operation will be understood from FIGS. 1 to 4 and their accompanying description. The tool comprises a drive module 161, an actuator device 110, and an interface assembly 162. In this embodiment, the apparatus is deployed on electric wireline. It will be appreciated that conveyance on slick line is possible in alternative embodiments of the invention (where downhole power is available), and the same tool could be deployed on drill pipe or coiled tubing if desirable.

The actuator device 110 is the same as the device shown in FIGS. 2 and 3. In this embodiment, the drive module is a downhole motor and pump drive module, and comprises a housing assembly 163 for a pump and motor (not shown). The housing assembly 163 is substantially cylindrical and is centrally disposed within the module. An annular chamber 164 is defined between the outer surface of the housing assembly and the inner surface of a drive module housing. A floating piston 165 is provided in the annular chamber and separates an upper sub chamber 166 from a lower sub chamber 167. The lower sub chamber 167 defines a hydraulic reservoir which is in fluid communication with the interface assembly via the pump, and the upper sub chamber 166 is initially filled with air at atmospheric pressure. In use, the floating piston 165 is movable to accommodate thermal expansion of the hydraulic fluid in the reservoir 167 and the hydraulic circuit.

Figure 6A:
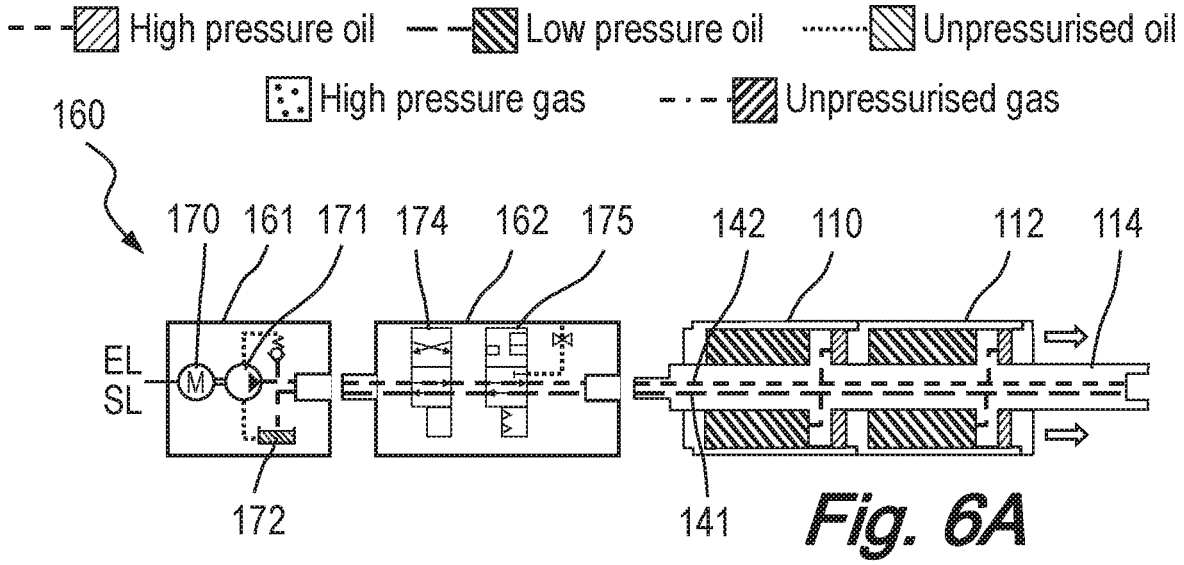
FIGS. 6A to 6C are schematic representations of the downhole tool of FIGS. 5A and 5B in various operating conditions.
Figure 6B:
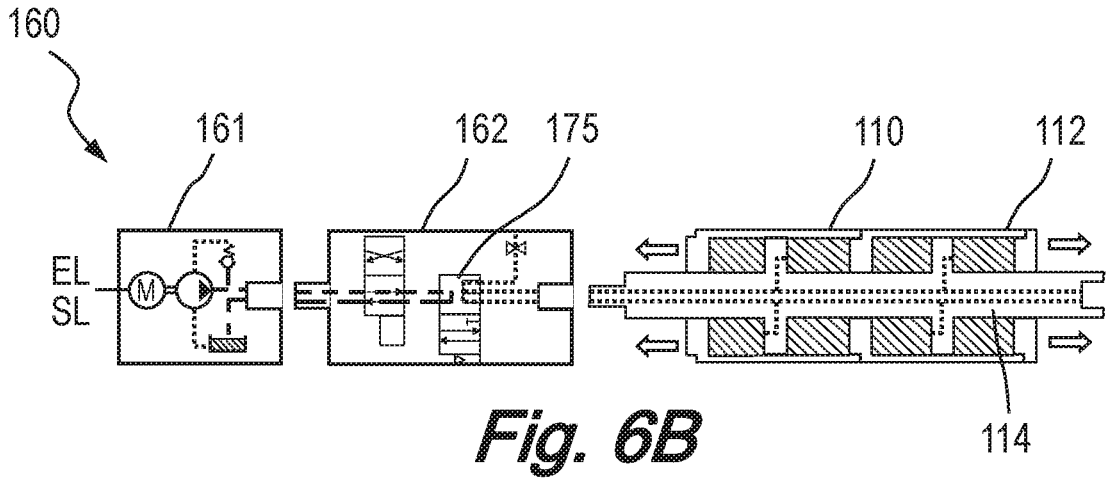
Figure 6C:
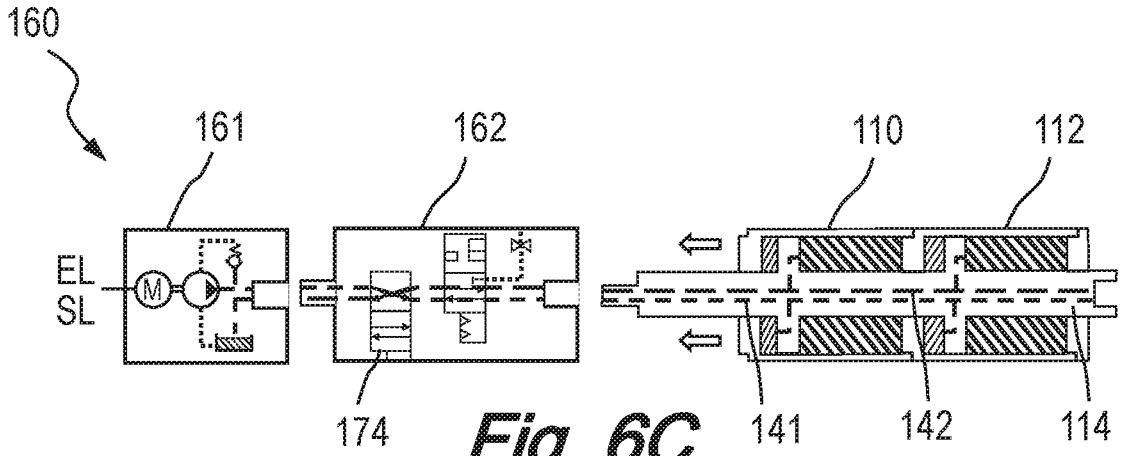

FIGS. 6A to 6C show schematically the operation of the downhole tool of FIGS. 5A and 5B. Each drawing shows schematically the drive module 161, the interface module 162, and the actuator device 110. The drive module 161 comprises a motor 170, a pump 171 and a reservoir of hydraulic fluid 173. A hydraulic circuit provides first and second fluid connectors to the first and second interface bores.

The dual bore configuration of the actuator device enables bidirectional operation, by inverting the application of pressure through the hydraulic system, and driving movement of the pistons in a reverse direction. The interface module therefore comprises a flow direction valve 174 which is configurable in first and second conditions to selectively determine the direction of pressure application in the device.

As noted above, a typical application of the invention is the setting and/or releasing of downhole plugs or packers. Most downhole plug systems rely on the shearing of a solid shear stud or shear ring attached to the plug in order to release the setting tool from the plug at the end of the setting sequence. A consequence of these configurations is that in the event of a failure in the setting tool system, which may result from motor burn out, a damaged piston seal or a gas leak, the setting tool can remain permanently attached to the plug which is partially set in the wellbore. This represents a significant operational problem and in some extreme cases may result in the loss of the well. Furthermore, in some cases, such as a burnt out motor-pump drive system, or an insufficient fluid column when relying on hydrostatic pressure, the partial setting force remains 'trapped' in the tool. This prevents various contingencies that might otherwise be employed (for example, a mechanical release system) from releasing the setting tool from the plug. To address this issue, the interface module 162 comprises a pressure dump valve 175 which is operable to equalise and/or vent hydraulic pressure retained in the tool as will be described below.

In the configuration shown in FIG. 6A, the apparatus is in an unset condition, with the outer housing 112 in its uppermost position on the inner rod 114. The flow direction valve 174 is in its setting position, with the pressurised outlet of the pump in fluid communication with the second bore 142 of the actuator device to act between the piston faces 132, 134. In use, the motor 170 is operated to pump high pressure hydraulic fluid along the first bore 142 to act on the outer housing, and low pressure hydraulic fluid is discharged from the chambers 122 to the fluid reservoir 173 via bore 141.

FIG. 6B schematically shows the same apparatus 160 in a pressure dump mode. This mode may be required when it is required to release the setting tool from a partially set plug as described above. In this condition, the pressure dump valve 175 is actuated to a pressure dump condition, which short circuits the first and second bores 142, 141 and vents internal pressure to the wellbore. Unpressurised hydraulic fluid flows on both sides of the pistons defined by the inner rod and is vented to the wellbore. The outer housing 112 is rendered free to move on the inner rod 114, and a mechanical release mechanism or other contingency can be operated to release the apparatus 160 from the partially set plug.

FIG. 6C shows the apparatus 160 in a pulling or releasing mode. In this condition, the flow direction valve 174 has been actuated to reverse the direction of the hydraulic circuit through the actuator device 110. High pressure fluid from the pump 171 is therefore provided to act on the piston faces 133, 135, and low pressure hydraulic fluid is returned to the reservoir via the first bore 142. The net force on the outer housing 112 causes it to move upwards on the inner rod.

Figure 7A:
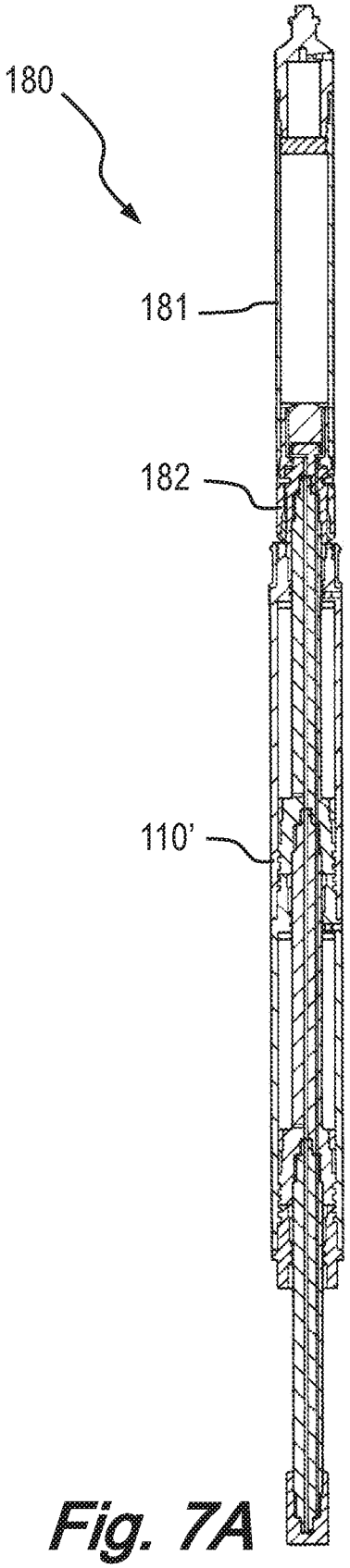
FIG. 7A is a longitudinal sectional view of a downhole tool according to an alternative embodiment of the invention, configured for use with a gas drive module.
Figure 7B:
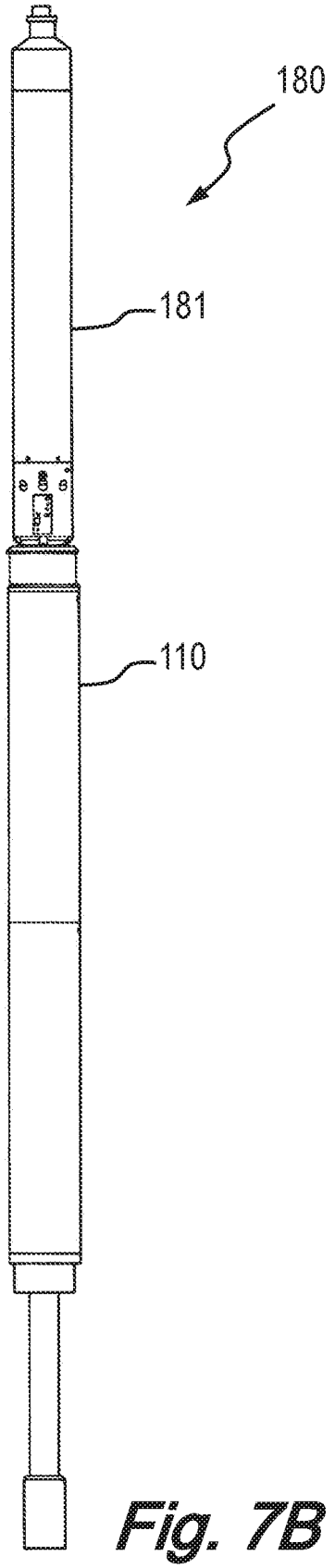
FIG. 7B is an elevation of the apparatus of FIG. 7A.

Referring to FIGS. 7A and 7B, there is shown a downhole tool according to an alternative embodiment of the invention. The downhole tool, generally depicted at 180, is shown in FIG. 7A in longitudinal section view and in FIG. 7B from a side view. The tool 180 is similar to the tools 100 and 160, and its features and operation will be understood from the foregoing description. The tool comprises a drive module 181, an actuator device 110, and an interface assembly 182. In this embodiment, the apparatus is deployed on slickline. It will be appreciated that conveyance on electric wireline drill pipe or coiled tubing is possible in alternative embodiments of the invention.

The actuator device 110 is the same as the device shown in FIGS. 2 and 3. In this embodiment, the apparatus 180 comprises a gas drive module 181. The gas drive module 181 may be any one of a number of gas drive modules known in the art, including but not limited to pyrotechnic, chemically and thermally reactive modules. In this embodiment, a chemical reaction is triggered within chamber 187, to generate a high pressure gas which drives the floating piston 183 to generate a flow of hydraulic fluid to the hydraulic circuit of the interface module 182.

Figure 8A:
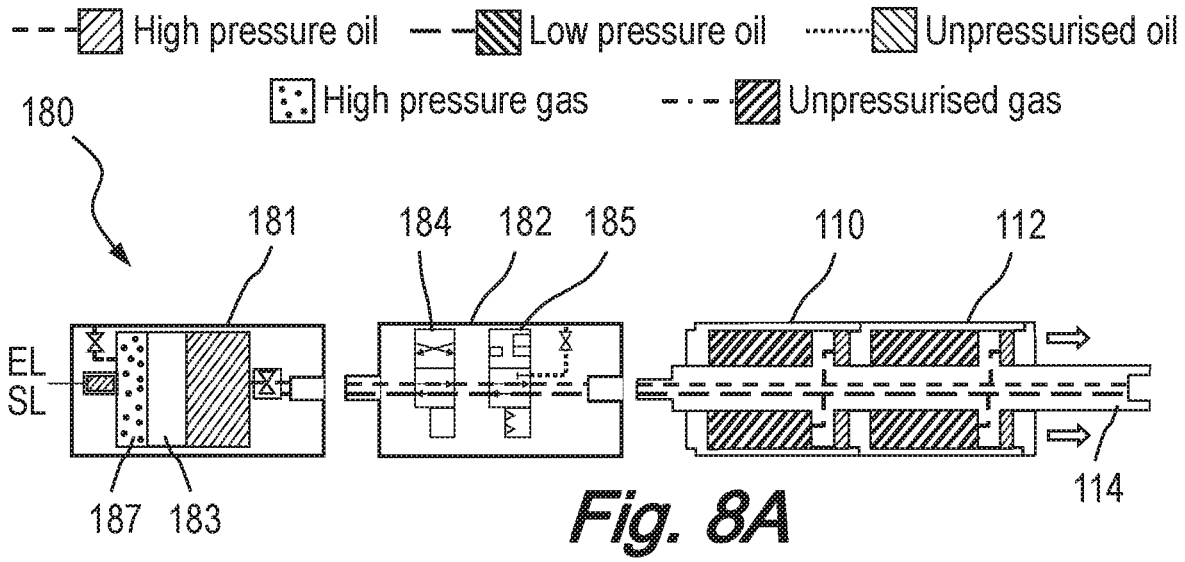
FIGS. 8A to 8C are schematic representations of the downhole tool of FIGS. 7A and 7B in various operating conditions.
Figure 8B:
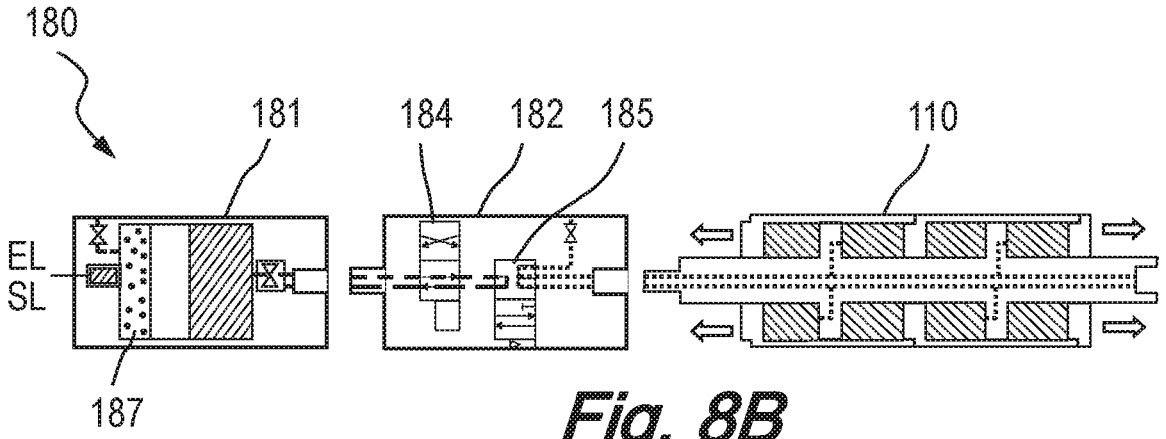
Figure 8C:
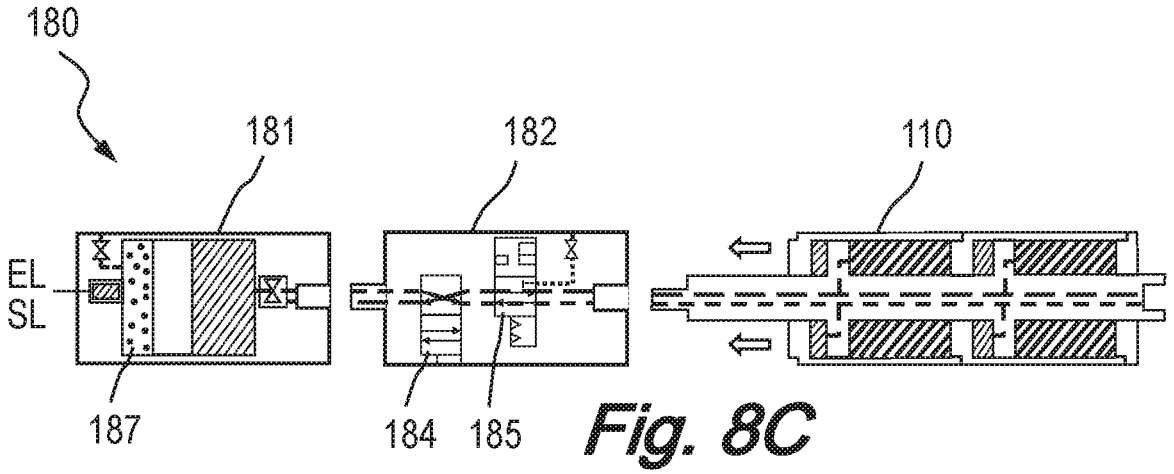

FIGS. 8A to 8C show schematically the operation of the downhole tool of FIGS. 6A and 6B. Each drawing shows schematically the drive module 181, the interface module 182, and the actuator device 110. The actuator device 110 is the same as the device shown in FIGS. 2 and 3, and is initially filled with unpressurised as (at atmospheric pressure). The interface module 182 comprises a flow direction valve 184 and a pressure dump valve 185, and in the configuration shown in FIG. 8A, the apparatus is in an unset condition, with the outer housing 112 in its uppermost position on the inner rod 114. The flow direction valve 184 is in its setting position, with the pressurised outlet from the gas drive module in fluid communication with the first bore 142 of the actuator device to act on the piston faces 132, 134 and move the outer housing downwards on the inner rod.

FIG. 8B schematically shows the same apparatus 180 in a pressure dump mode. In this condition, the pressure dump valve 185 is actuated to a pressure dump condition, which short circuits the first and second bores 142, 141. Unpressurised hydraulic fluid flows on both sides of the pistons defined by the inner rod and is vented to the wellbore. The outer housing 112 is rendered free to move on the inner rod 114, and a mechanical release mechanism or other contingency can be operated to release the apparatus 180 from the partially set plug.

FIG. 8C shows the apparatus 180 in a pulling or releasing condition. In this condition, the flow direction valve 184 has been actuated to reverse the direction of the hydraulic circuit through the actuator device 110. High pressure fluid from the drive module is therefore provided to act on the piston faces 133, 135, the net force on the outer housing 112 causes it to be pulled upwards on the inner rod.

Figure 9A:
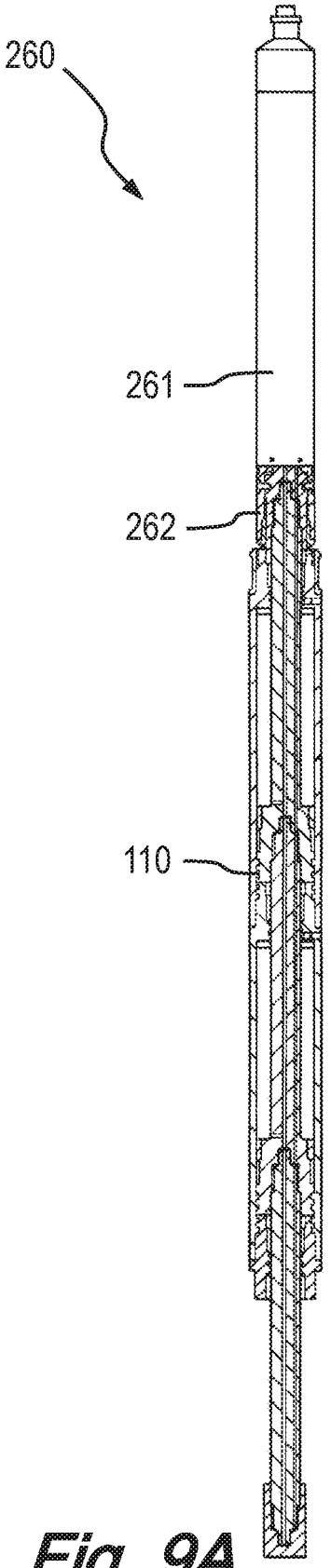
FIG. 9A is a longitudinal sectional view of a downhole tool according to an alternative embodiment of the invention, configured for use with a surface pump drive system.
Figure 9B:
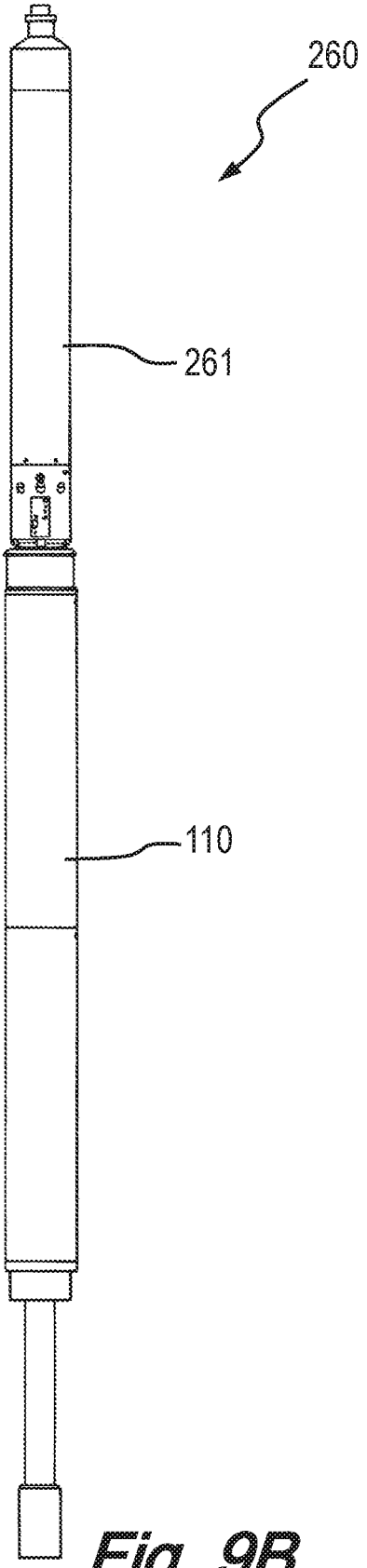
FIG. 9B is an elevation of the apparatus of FIG. 9A.

Referring now to FIGS. 9A and 9B, there is shown a downhole tool according to an alternative embodiment of the invention. The downhole tool, generally depicted at 260, is shown in FIG. 9A in a longitudinal section view and in FIG. 9B from a side view. The downhole tool 260 is similar to the tools 100, 160 and 180, and its features and operation will be understood from the foregoing description. The tool comprises a drive module 261, an actuator device 110, and an interface assembly 262. The actuator device 110 is the same as the device shown in FIGS. 2 and 3. In this embodiment, the downhole tool comprises a hydraulic drive module which is configured to be driven by surface pump pressure, and the downhole tool is deployed on drill pipe. It will be appreciated that deployment on coiled tubing is possible in an alternative embodiment of the invention.

Figure 10A:
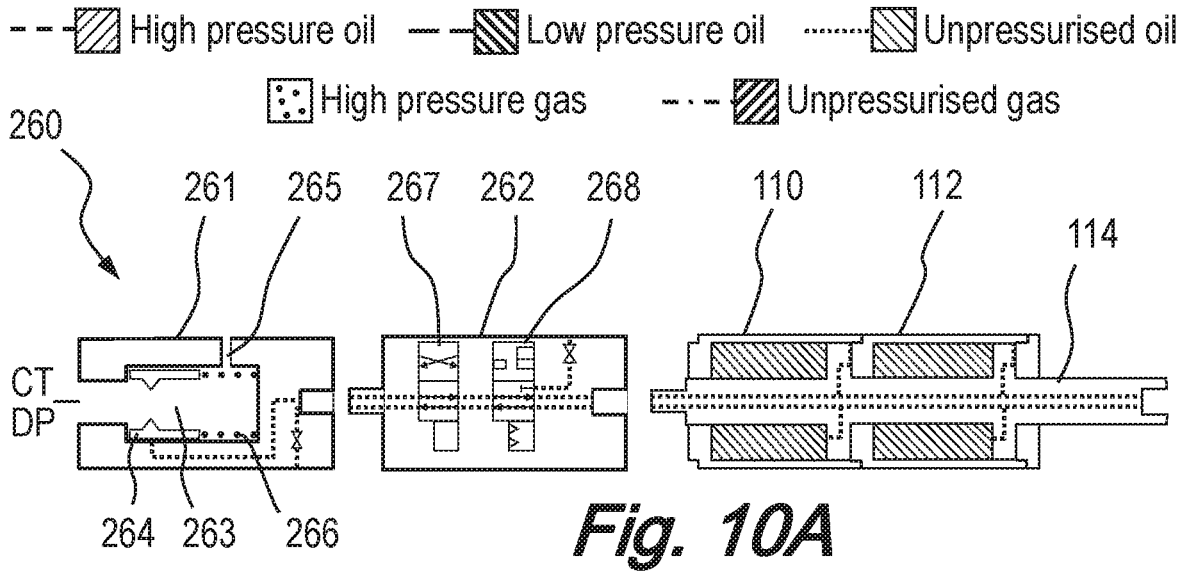
FIGS. 10A to 10C are schematic representations of the downhole tool of FIGS. 9A and 9B in various operating conditions.
Figure 10B:
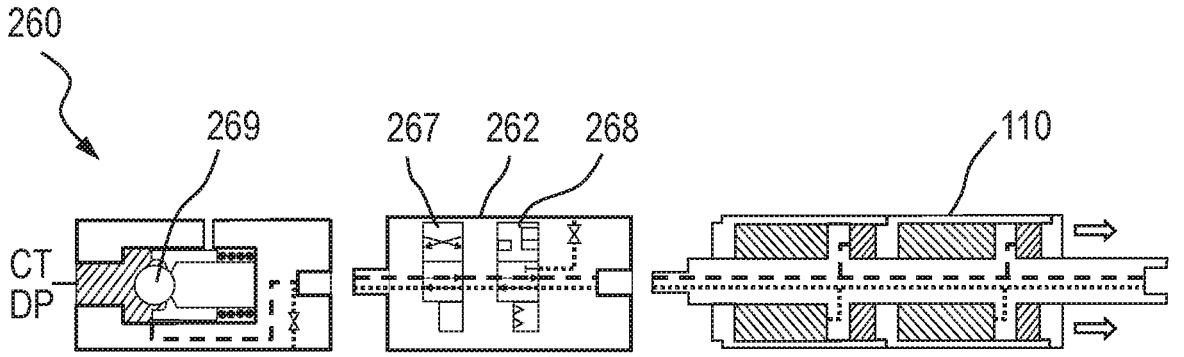
Figure 10C:
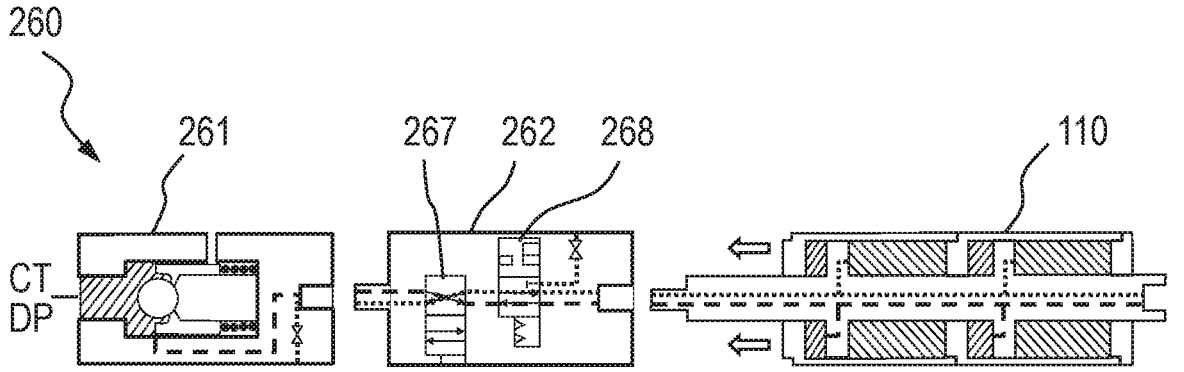

FIGS. 10A to 10C show schematically the operation of the downhole tool 260 of FIGS. 9A and 9B. Each drawing shows schematically the drive module 261, the interface module 262, and the actuator device 110. FIG. 10A shows schematically the downhole tool in a run-in condition. The hydraulic system and annular chambers of the actuator device 110 are initially filled with unpressurised oil. The hydraulic drive module incorporates a fluid cavity 263 which is in fluid communication with a bore of the drill pipe on which the downhole tool is conveyed. The cavity 263 comprises a sliding sleeve which carries a valve seat 264. A biasing spring 266 urges the sleeve 264 towards an upper position, in which the fluid cavity is sealed from a hydraulic line that is in communication with the interface module 262. A lower part of the fluid cavity comprises an outlet 265, enabling flow of fluid through the cavity when the sleeve is in its upper position as shown in FIG. 10A.

FIG. 10B shows the same apparatus 260 in a setting position. A ball 269 is dropped from surface through the drill pipe and is pumped (or falls by gravity) to rest on the valve seat 264. Fluid is pumped from surface, using surface pumps, through the drill pipe and to the hydraulic drive module 261. Pressure builds on the upper side of the ball and sleeve until it is sufficient to overcome the force of the biasing spring and move the sleeve downwards to expose the hydraulic line to the interface module 262. High pressure fluid may therefore be pumped through the interface module 262 and into the first bore of the actuator device to act on the actuator pistons and move the outer housing to its lower, set position. Hydraulic fluid on the opposing side of the actuator pistons is returned to the drive module and vented to the wellbore.

The apparatus 260 may also be used in a reverse mode, and FIG. 10C schematically shows the downhole tool in this condition. The flow direction valve 267 has been actuated to reverse the direction of the hydraulic circuit through the actuator device. High pressure fluid from the drive module is therefore provided to act on piston faces 133, 135, and unpressurised hydraulic fluid is returned to the drive module 261 to discharge to the wellbore. The net force on the outer housing causes it to be pulled upwards on the inner rod to a release position. Optionally, the tool 260 also provides a fluid drain path, so that when fluid pumped from surface is depressurised and the downhole tool is recovered to surface, fluid which is present above the ball and valve seat is allowed to drain into the wellbore.

The downhole tool 260 may also be configured in a pressure dump mode, which may be required when it is required to release the setting tool from a partially set plug as described above. In this condition, the pressure dump valve 268 is actuated to a pressure dump condition, which short circuits the first and second bores and vents internal pressure to the wellbore. Unpressurised hydraulic fluid flows on both sides of the pistons defined by the inner rod and is vented to the wellbore. The outer housing 112 is rendered free to move on the inner rod 114, and a mechanical release mechanism or other contingency can be operated to release the apparatus from the partially set plug.

Figure 11A:
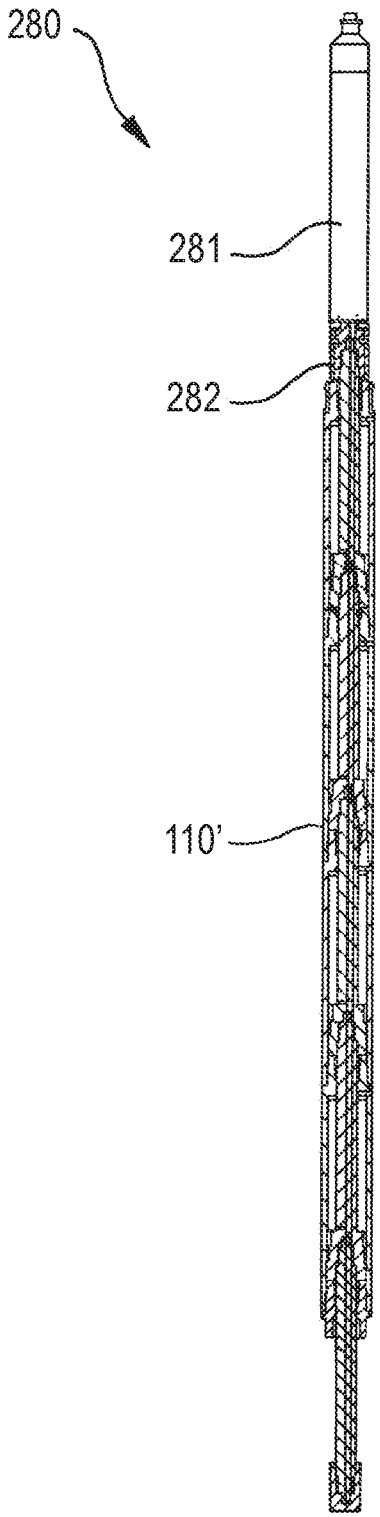
FIG. 11A is a longitudinal sectional view of a downhole tool according to an alternative embodiment of the invention, configured for use with a hydrostatic pressure drive system.
Figure 11B:
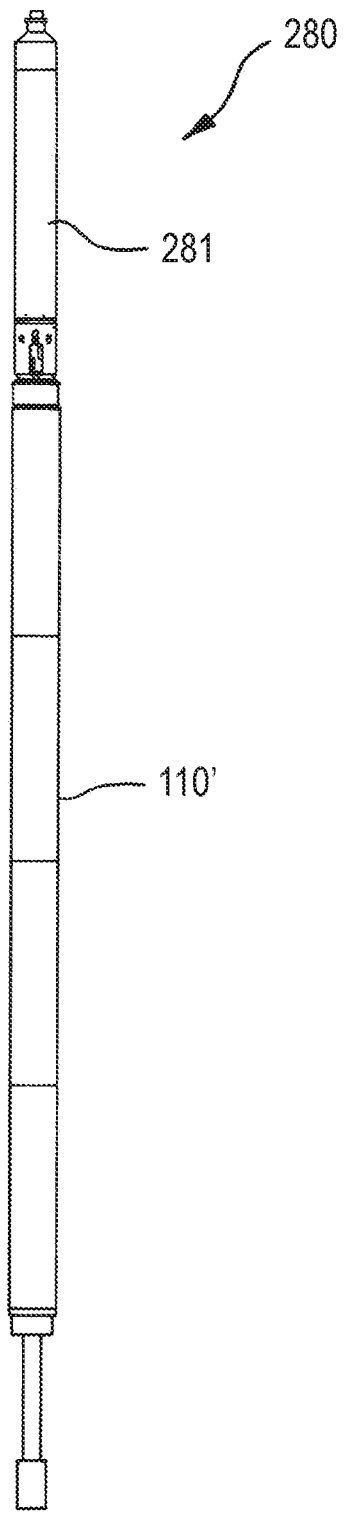
FIG. 11B is an elevation of the apparatus of FIG. 11A.

Referring now to FIGS. 11A and 11B, there is shown a downhole tool according to a further alternative embodiment of the invention. The downhole tool, generally depicted at 280, is shown in FIG. 11A in a longitudinal sectional view, and in FIG. 11B from a side view. The tool 280 is similar to the tool 100, 160, 180 and 260, and its features and operation will be understood from the foregoing description. The tool comprises a drive module 281, an actuator device 110', and an interface assembly 282. In this embodiment, the downhole tool 280 comprises a hydrostatic drive module operable to be driven by wellbore pressure, and is deployed on drill pipe. It will be appreciated that the downhole tool may be deployed on coiled tubing in alternative embodiments of the invention.

Figure 12A:
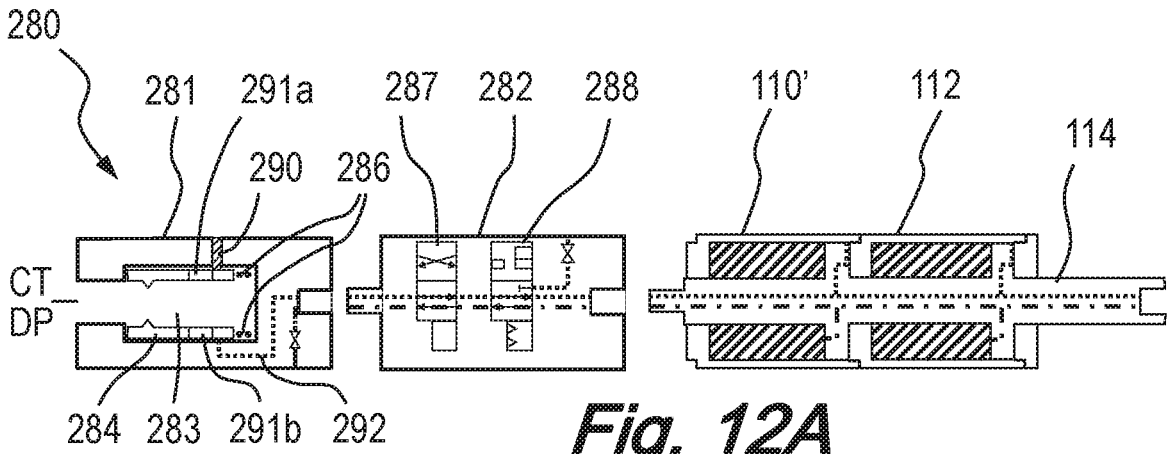
FIGS. 12A to 12C are schematic representations of the downhole tool of FIGS. 11A and 11B in various operating conditions.
Figure 12B:
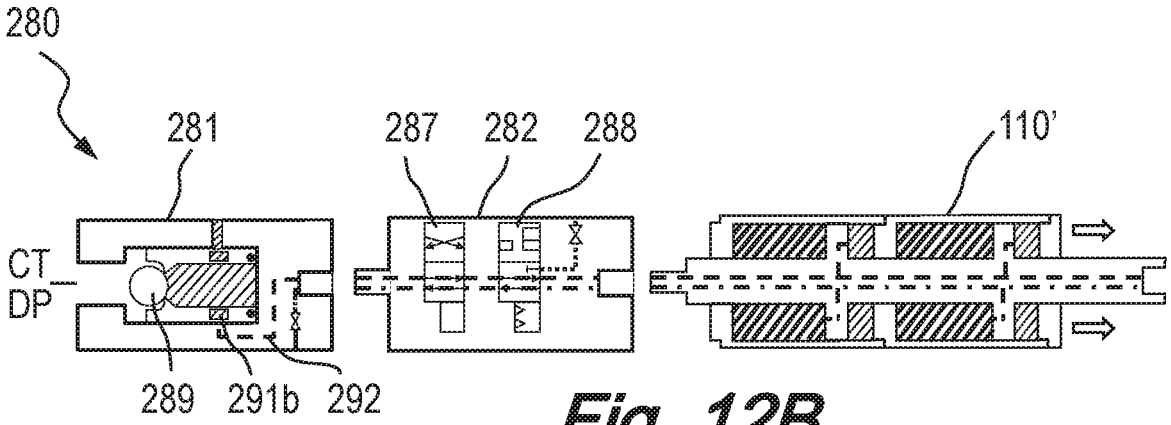
Figure 12C:
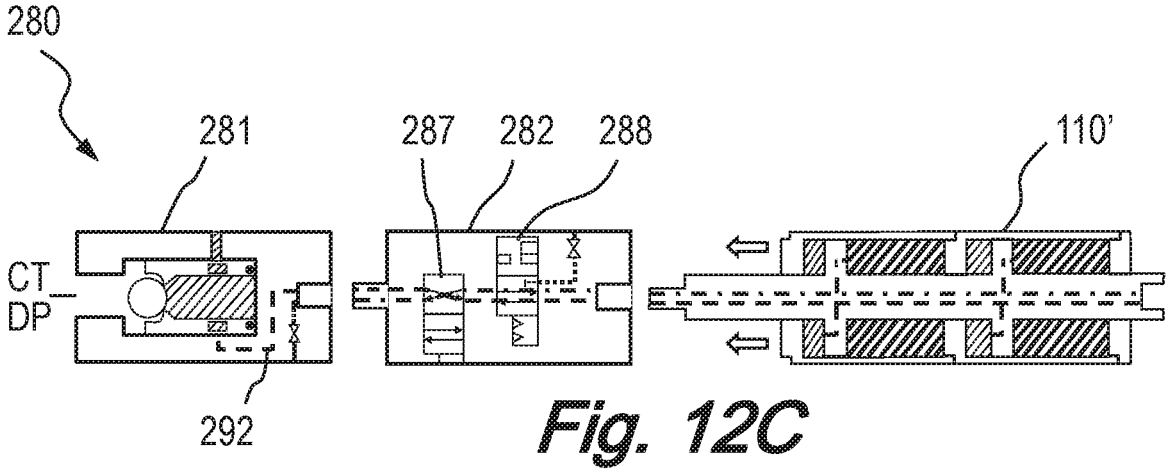

The actuator device 110' is similar to the device shown in FIGS. 2 and 3, although the actuator device comprises four stacked piston modules. The use of four piston modules enables a suitable output force to be generated from a lower system pressure. FIGS. 12A to 12C show schematically the operation of the downhole tool 280 of FIGS. 11A and 11B. Each drawing shows schematically the drive module 281, the interface module 282, and the actuator device 110'. FIG. 12A shows schematically the downhole tool in a run-in condition. The hydraulic system and annular chambers of the actuator device 110' are initially filled with unpressurised gas (at atmospheric pressure). The hydraulic drive module incorporates a fluid cavity 283 which is in fluid communication with a bore of the drill pipe on which the downhole tool is conveyed. The cavity 283 comprises a sliding sleeve 284 which carries a valve seat 285. The sleeve 284 comprises flow apertures 291*a*, 291*b* which connect the outside of the sleeve with the cavity 283. A port 290 in the drive module is in communication with hydrostatic fluid in the wellbore. A flow line 292 is in fluid communication with the bore 142 of the actuator device. A biasing spring 286 urges the sleeve 284 towards an upper position, in which the fluid cavity 283 is isolated from the port 290 and the flow line 292.

FIG. 12B shows the same apparatus 280 in a setting position. A ball 289 is dropped from surface through the drill pipe and is pumped (or falls by gravity) to rest on the valve seat 284. Fluid is pumped from surface, using surface pumps, through the drill pipe and to the hydraulic drive module 281. Pressure builds on the upper side of the ball and sleeve until it is sufficient to overcome the force of the biasing spring 286 and move the sleeve downwards to align the aperture 291*a* with the port 290 to expose the cavity 283 to hydrostatic fluid. At the same time, aperture 291*b* is aligned with the flow line 292. hydrostatic pressure is therefore communicated to the interface module 282 and into the first bore of the actuator device to act on the actuator pistons to compress the gas on the opposing side of the pistons and move the outer housing to its lower, set position.

The tool 280 may also be used in a reverse mode as shown in FIG. 12C. The flow direction valve 287 has been actuated to reverse the direction of the hydraulic circuit through the actuator device. Hydrostatic pressure from the drive module is therefore provided to act on piston faces 133, 135, and move the outer housing to a release position. Optionally, the tool 280 also provides a fluid drain path, so that when fluid pumped from surface is depressurised and the downhole tool is recovered to surface, fluid which is present above the ball and valve seat is allowed to drain into the wellbore.

The downhole tool 280 may also be configured in a pressure dump mode. In this condition (not shown), the pressure dump valve 268 is actuated to a pressure dump condition, which short circuits the first and second bores and vents internal pressure to the wellbore. A mechanical release mechanism or other contingency can be operated to release the apparatus from the partially set plug.

As noted above, a typical application of the invention is the setting and/or releasing of downhole plugs or packers, and it is desirable to incorporate a mechanism for releasing a setting force or pressure which has built up in the event of a drive failure (or other system failure); and to provide a reversible, directional tool to enable release of the plug or packer to be set.

Although these valve functions may be implemented in a number of different ways within the scope of the invention, including using conventional valve modules as schematically shown in FIGS. 6, 8, 10 and 12, in a preferred embodiment of the invention, the valve functions are implemented in a single compact module that enables both functions. An example embodiment is described with reference to FIGS. 13, 14 and 15, which show a valve module 300 incorporating flow reversing and pressure dump capabilities.

Figure 13:
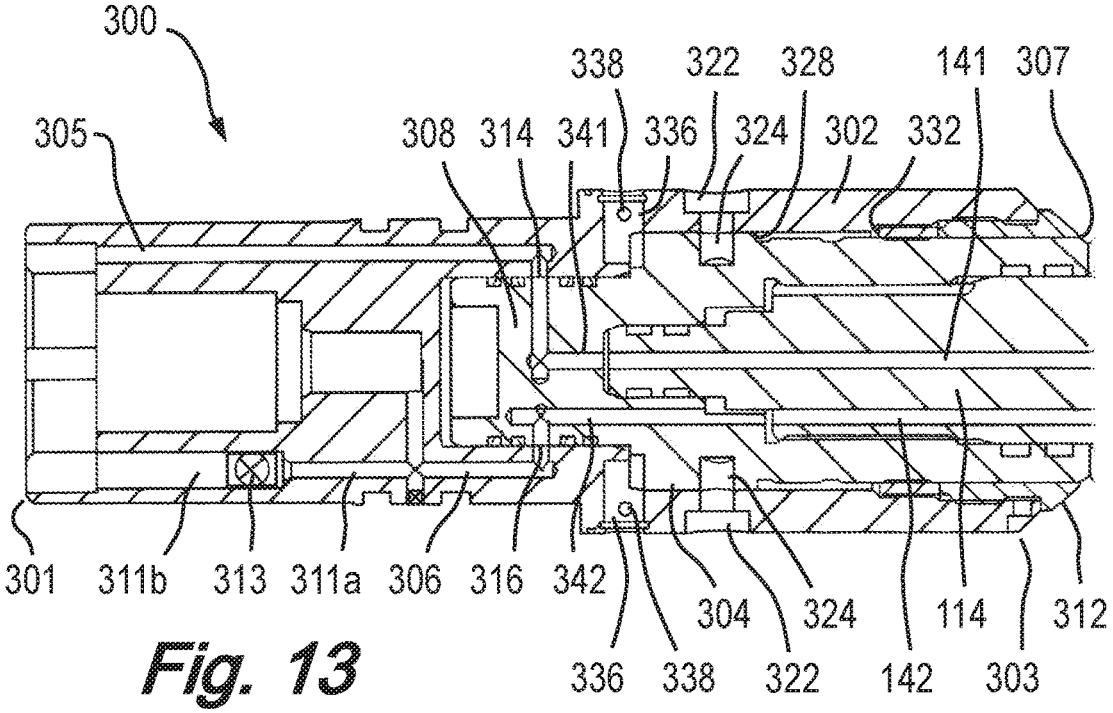
FIG. 13 is a sectional view of a valve module of a preferred embodiment of the invention.
Figure 14:
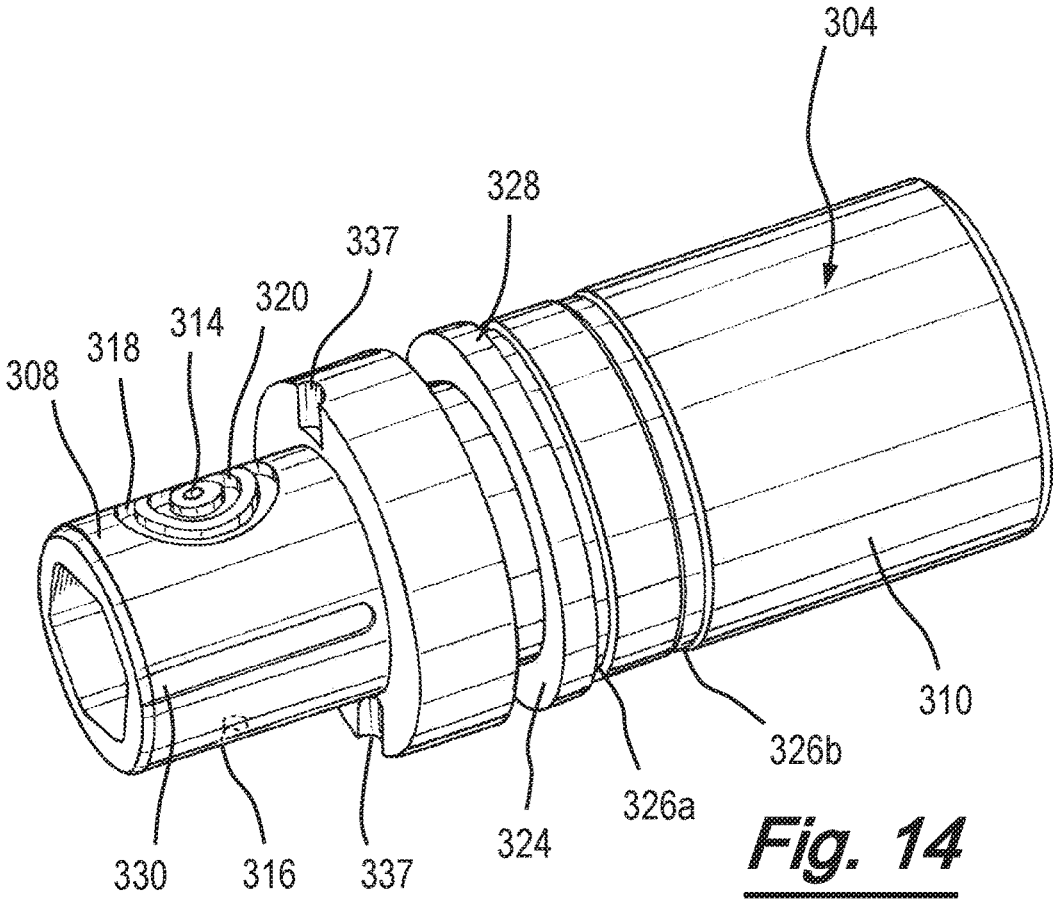
FIG. 14 is an isometric view of a body sub assembly of the valve module of FIG. 13.

FIG. 13 is a longitudinal sectional view of the valve module 300 in an assembled, setting position. The valve module 300 comprises a housing sub assembly 302 and a body sub assembly 304. FIG. 14 is an isometric view of the body sub assembly 304.

The housing sub-assembly 302 is substantially cylindrical and comprises an upper end 301 which interfaces with the drive module (not shown). The upper end comprises mechanical and fluid connectors for the drive module, including first and second interface bores 305, 306. A relief bore 311*a*, 311*b* provides a fluid path from the bore 306 (on the side of the pressure source) to the bore 305 (on the hydraulic fluid return side). An enlarged portion 311*b* optionally accommodates a relief valve 313. Extending from a lower end 303 of the housing 302 is a blind bore 307, which is sized and shaped to accommodate the body 304. The blind bore 307 comprises a stepped profile, with a reduced diameter portion of the blind bore sized to receive and seal with a neck portion 308 of the body. The main mandrel 310 of the body 304 is sized to fit within an enlarged bore portion of the bore 307. A retaining ring 312 is disposed between the housing 302 and the body 304.

The body 304 comprises a recess at its lower end, which is shaped and sized to receive a male connector of the inner rod section 314. First and second bores 142, 141 are in fluid communication with bores 342, 341 in the body sub-assembly. The bores 341, 342 exit the body sub-assembly in a radial direction, to exit point 314, 316 located in the neck portion 308. The exit points 314, 316 are diametrically opposed at 180 degrees from one another.

Surrounding the exit point 314 on the cylindrical surface of the neck portion 308 are circular recesses 318, 320 which accommodate elastomeric seals. The seals form a double elastomeric fluid seal between the body sub-assembly 304 and the housing sub-assembly 302 around the exit point. An identical arrangement of recesses and seals is provided around exit point 316. The interface bores 305, 306 are in fluid communication with the exit points.

Provided in the housing sub-assembly are radial apertures 322, aligned with recesses 324 in the body sub-assembly. Shear pins (not shown) extend through the apertures 322 and into the holes 324 to retain the housing sub-assembly 302 and the body sub-assembly 304 together. Apertures 336 in the housing sub-assembly correspond to the position of part-circular recesses 337 in the edge of the body 304. The apertures 336 and recesses 337 together accommodate locating pins (not shown) when the assembly is in the position shown in FIG. 13, or when the respective sub-assemblies are rotated with respect to one another by 180 degrees. In this embodiment, the pins are spring-loaded pins which are removably mounted in the apertures 336. When the housing sub-assembly is not in the correct rotational position with respect to the body sub-assembly, the pins are supported by the edge of the body 304. The apertures 336 are also provided with side bores 338 which enable the pins to be supported in an outer position during assembly.

When the housing sub-assembly is not in the correct rotational position with respect to the body sub-assembly, the pins align with the recesses and the action of the springs forces them inwards to rotationally key the sub-assemblies with respect to one another in the desired alignment. The housing sub assembly and body sub assembly are also provided with visual alignment indicators to facilitate correct alignment.

The body 304 is provided with a profiled outer surface providing an axially separated pair of annular recesses 326*a*, 326*b*, and a downward facing shoulder 328. The recesses and the shoulder are designed to engage with a mechanism on the locking ring 312, as will be described below. Axial grove 330 on the neck portion, along with an optional corresponding axial groove on a diametrically opposed surface, functions to reduce or minimise hydraulic lock between the two sub-assemblies.

Figure 15A:
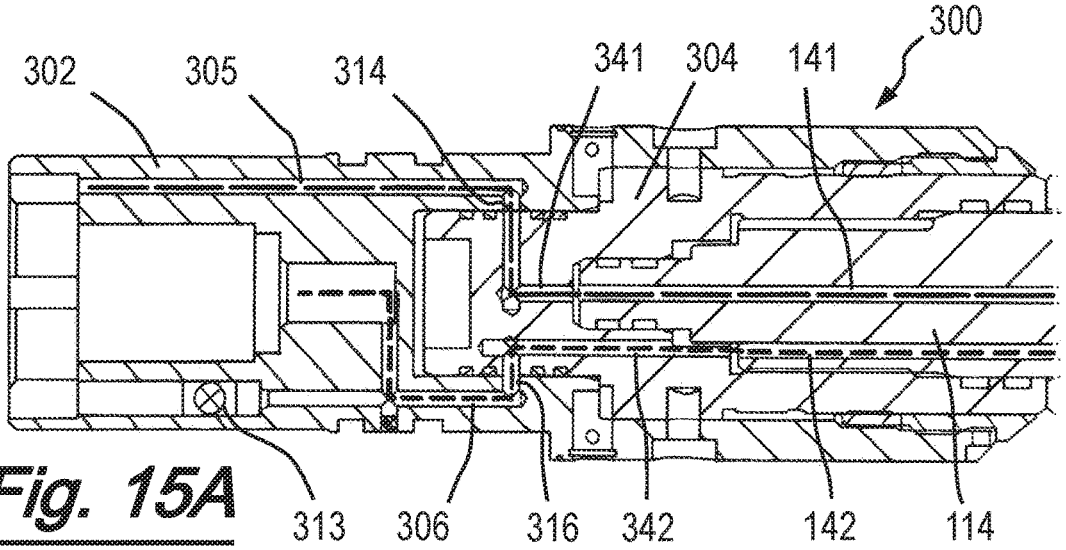
FIGS. 15A to 15C are sectional views through the valve module of FIG. 14, shown in various operating positions.
Figure 15B:
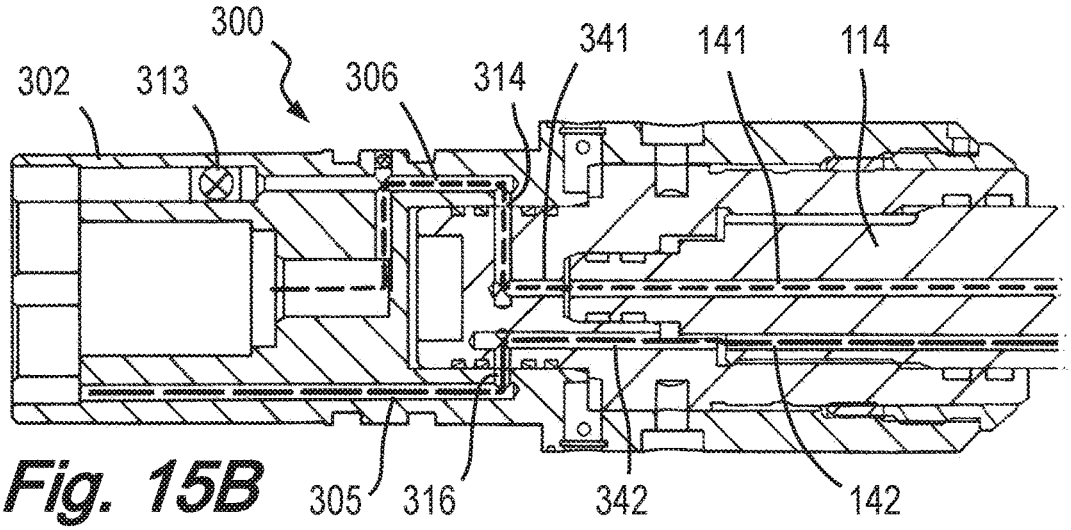
Figure 15C:
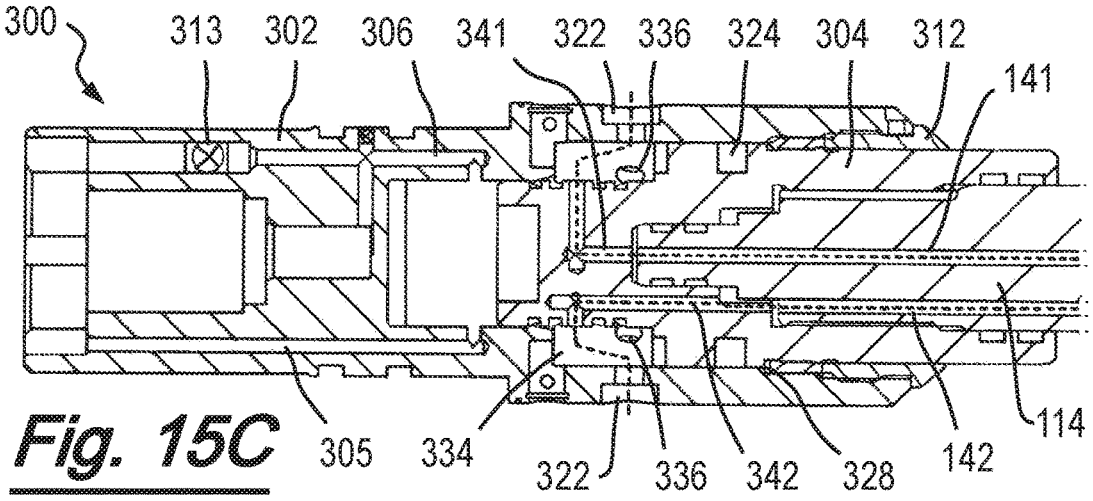

FIGS. 15A to 15C are longitudinal sectional views of the interface module 300 respectively in forward flow, reverse flow and pressure dump conditions. The interface module 300 is shown assembled with an inner rod section 314.

In the first condition, shown in FIG. 15A, the valve module functions to provide a fluid communication path between the drive module and the first and second bores of the inner rod 114. FIG. 15A shows the apparatus in a setting mode, in which high pressure hydraulic fluid is provided by the drive module in the interface bore 306, the bore 342, and into the first bore 142 of the inner rod 114. On the opposing side of the piston faces defined by the inner rod, low pressure hydraulic fluid is present in the second bore 141, the bore 341 and the interface bore 305. This forward flow configuration effects downward movement of the outer housing on the inner rod.

The optional relief valve 313 functions to relieve pressure from the bore 306 (downstream of the hydraulic pressure source) to bypass the actuator device when the actuator device reaches its full stroke, or in the event of tool failure, for example if the tool becomes stuck mid-stroke. The inclusion of a pressure relief valve is preferred in embodiments which include a motor-pump drive module. When the actuator gets to the end of its stroke, the pressure applied from the drive module would rise to the maximum rated output of the pump/motor combination and put undue stress onto that system and the related power supply until the motor is shut down. When the pressure threshold of the valve 313 is exceeded, the valve opens to shunt this pressure to the return reservoir, to prevent the pump from "dead-heading". The motor and pump combination are therefore only required to operate to the pressure determined by the threshold of the pressure relief valve.

The configuration of the valve module 300 enables the downhole tool to be operated in a reverse direction. Such a configuration is shown in FIG. 15B. In this mode, the housing sub-assembly has been inverted by rotating it 180 degrees with respect to the housing sub-assembly prior to re-assembling the valve module. In this embodiment, the configuration of the valve module is performed at surface, prior to running the downhole tool. The housing and body are separated, rotated relative to one another by 180 degrees, and re-assembled to the configuration shown in FIG. 15B. In this mode, high pressure hydraulic fluid is delivered from the drive module through bore 306 and into bore 341. Low pressure hydraulic fluid is returned from bore 342 via 342 and into interface bore 306. In the configuration of FIG. 15B, the tool is actuated to pull or release the downhole tool.

As noted above, in the event of a setting sequence failure, in which a partial setting force has been applied such that the plug is partially set and the chambers and the fluid lines of the actuator device are at elevated pressure, it is desirable to release the pressure in the hydraulic system. With the valve module 300, this mode of operation is shown in FIG. 15C. An upward force or overpull is applied to the housing sub-assembly via the wellbore conveyance. When this overpull is sufficient to shear the shear pins (not shown) located in the apertures 322 and annular groove 324, the housing sub-assembly 302 moves upwards with respect to the body sub-assembly 304, until the shoulder 328 abuts an upper shoulder 332 of the locking ring 312. A ratchet mechanism provided on the locking ring engages the grooves 326*a*, 326*b* to prevent relative movement of the housing sub-assembly and the body sub-assembly until the module is reset at surface.

In this position, the radial exit point 314, 316 of the bores 341 and 342 are exposed to annular chamber 334. Any pressure differential between the first and second bores 142, 141 of the inner rod 114 is equalised; i.e. the hydraulic circuit between the bores 141, 142 is 'shorted' through the annular chamber 334. In addition, shearing of the pins opens vent holes 336, which open a fluid path from the annular chamber 334 and the exterior of the tool. The pressure in the annular chamber 334 is therefore equalised with wellbore pressure, and any excess pressure in the tool is vented to the wellbore annulus. With the pressure equalised in the device, and equalised with wellbore pressure, a contingency such a mechanical release system to release the setting tool for the partially set plug, enabling the setting tool to surface. The vent holes 336 are circumferentially offset from the apertures 322, to prevent parts of the shear pins being dropped into the annular space 322 in use.

Figure 16A:
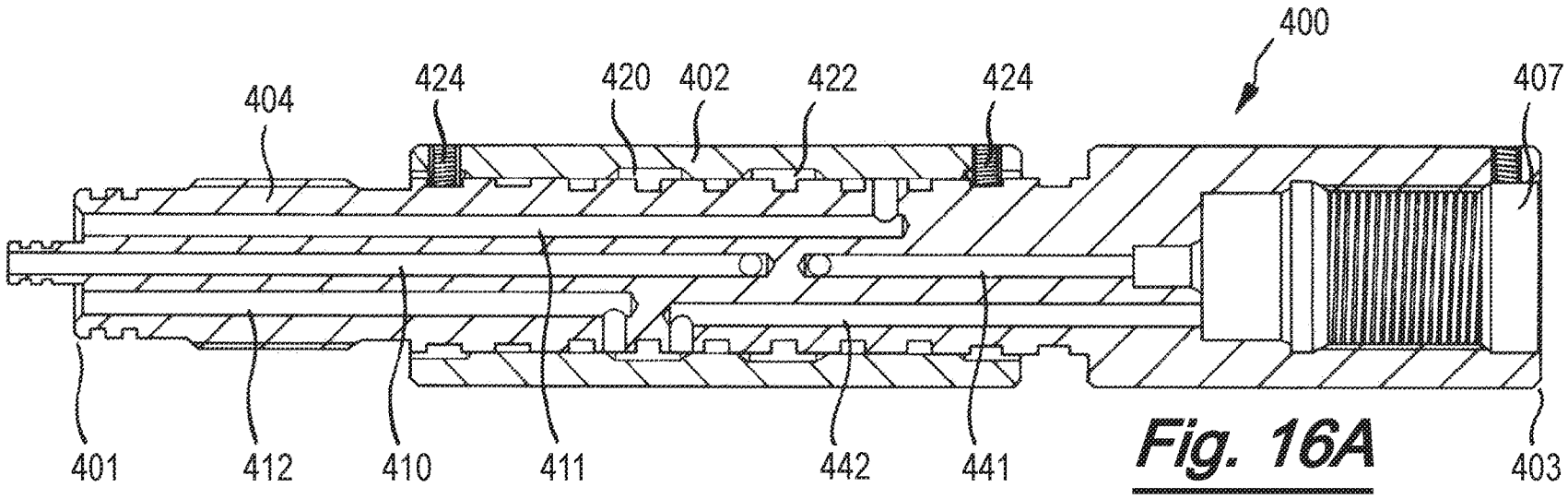
FIGS. 16A and 16B are sectional views through a valve module according to an alternative embodiment of the invention, shown respectively in first and second operating positions.
Figure 16B:
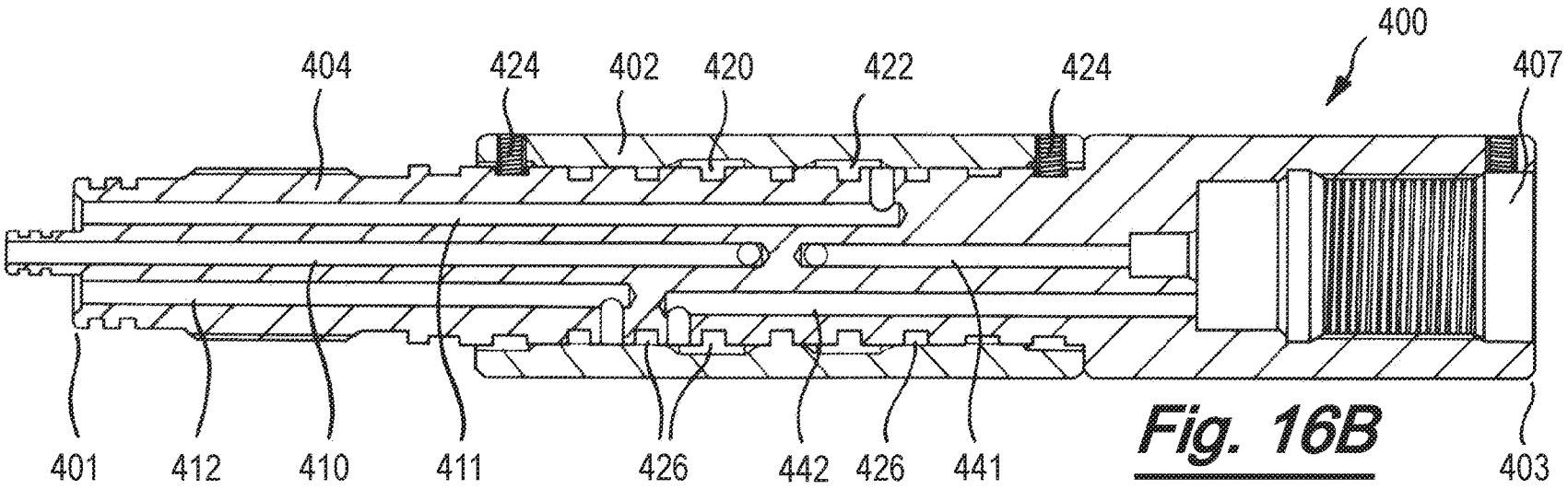

FIGS. 16A and 16B are longitudinal sections through a valve module according to an alternative embodiment of the invention. FIG. 16A shows the valve module in a first, forward flow condition, and FIG. 16B shows the valve module in a second, reverse flow condition.

The valve module 400 comprises a body sub-assembly 404 and a sliding sleeve 402 disposed on the body, and is configured as a shuttle valve. The body sub-assembly comprises a first upper end 401 configured for attachment to a drive module, and a second, lower end 402 is configured for attachment to an inner rod of an actuator device. In this embodiment, the inner rod is configured for threaded mating with a recess 407 of the body.

The body comprises a first bore 410 orientated along a longitudinal axis of the body, and a pair of radially offset upper bores 411, 412. The bores 410, 411, 412 are fluidly connected to a hydraulic drive module (not shown). The body also comprises lower bore 441, which is fluidly connected with a second bore of the inner rod in use, and lower bore 442 is fluidly connected with a first bore of the inner rod. Each of the bores in the body is provided with a radial port, with the radial ports being axially spaced along the body.

The sleeve 402 comprises a pair of annular recesses 420, 422 which may be selectively aligned with pairs of radial ports to connect the bores. Grub screws 424 secure the sleeve with respect of the body in the required axial position, and annular seals 426 are provided between the sleeve and the body between the locations of the radial ports.

In a first, forward flow position, shown in FIG. 16A, annular recess 420 fluidly connects the radial ports of the bore 412 and the bore 442, and annular recess 422 fluidly connects the radial exit points of the bore 410 and the bore 441. Pressurised hydraulic fluid delivered by the drive module to bores 412 and 411 delivered to the bore 442 via the annular recess 420, and is delivered to the first bore of the inner rod to act on the piston faces and push the outer housing of the actuator device to a downward, set position. High pressure fluid in the bore 411 is blanked due to location of its radial port between a pair of annular seals. Low pressure fluid on the reverse side of the piston faces is returned to the drive module via the bore 441, the annular recess 422 and the bore 410.

In the configuration shown in FIG. 16B, the sleeve has been moved on the body to a lower position at which it has been secured using grub screws 424. In this configuration, the annular recess 422 connects the bore 411 with the bore 441 and the annular recess 420 connects the bore 442 with the bore 410. Pressurised hydraulic fluid in the bore 411 is therefore able to pressurise hydraulic fluid in the second bore of the inner rod via the annular recess 422. This pressure acts on the piston faces in a reverse direction to pull the outer housing upwards on the inner rod.

In practice, the valve module 400 is configured in its first and second position at surface by undoing grub screws 424, sliding the sleeve on the body and re-attaching the grub screws. However, it will be appreciated that in alternative embodiments of the invention, the sleeve may be configured to be actuated from a remote location, to move between first and second positions, such that the flow direction can be reversed while the valve module is in position downhole.

Figure 17A:
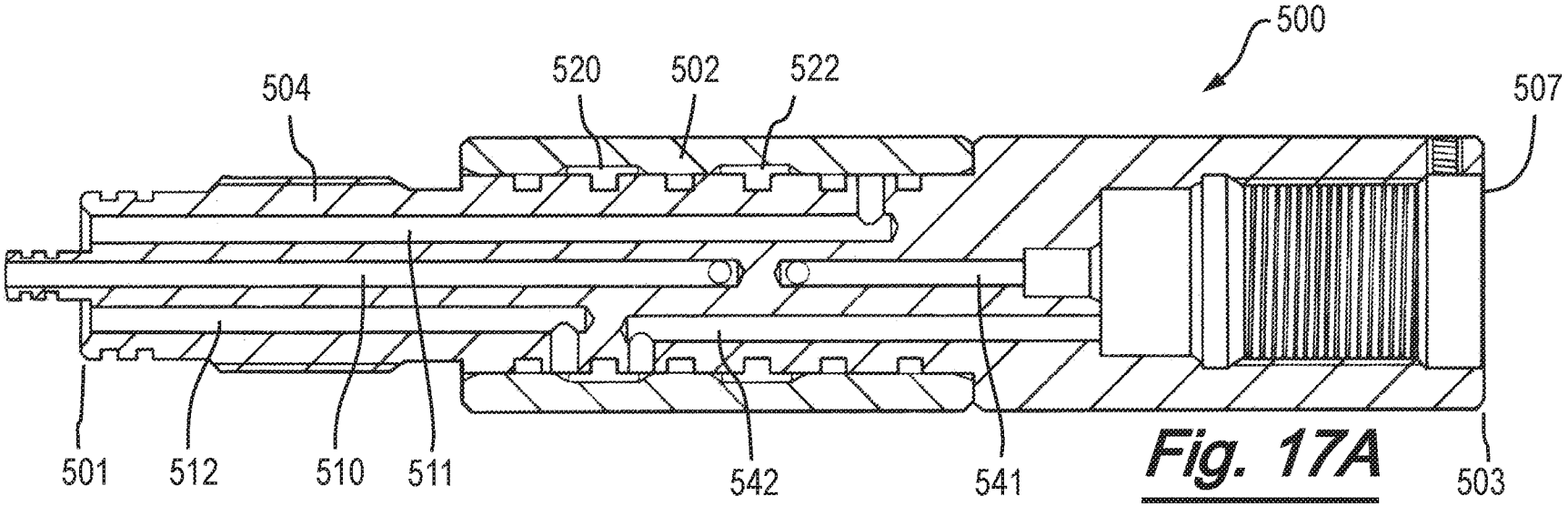
FIGS. 17A and 17B are sectional views through a valve module according to a further alternative embodiment of the invention, shown respectively in first and second operating positions.
Figure 17B:
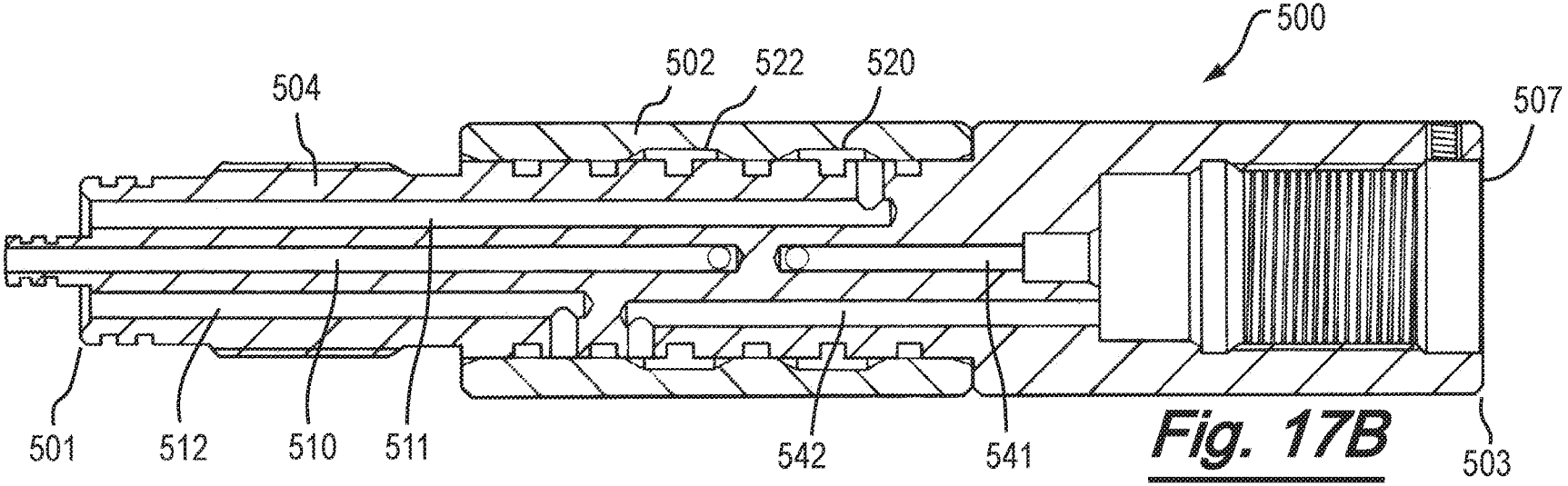

Referring now to FIGS. 17A and 17B, there is shown a valve module according to a further embodiment of the invention. The valve module 500 is similar to the valve module 400, and its features and operation will be understood from FIGS. 16A, 16B and the accompanying description. The valve module 500 comprises a sleeve 502 disposed on a body 504. The valve module 500 is similar to the body 400, with like components indicated by like reference numerals incremented by 100. However, the valve module 500 differs from the valve module 400 in the configuration of the body and the sleeve. The sleeve 502 is asymmetric about a central plane perpendicular to its axis, with the annular recesses 520 and 520 disposed towards a first end 521 of the sleeve. When assembled in the configuration shown in FIG. 17A, the annular recesses are disposed towards an upper end 501 of the body, and are aligned to connect radial ports of the bores 512 and 542 through recess 520, and bores 510 and 541 through recess 522. In this configuration, the flow direction is forwards, with pressurised hydraulic fluid in bore 512 being delivered to the first bore of the inner rod, and lower pressure fluid being returned from the second bore of the inner rod through bore 541, annular recess 522 and bore 510.

In the configuration shown in FIG. 17B, the sleeve has been flipped, with its first end towards a lower end of the sleeve. In this position, the annular recesses are disposed towards a lower end 503 of the body, and are aligned to connect bores 511 and 541 through annular recess 522, and bores 510 and 542 through annular recess 520. In this mode of operation, the flow direction of the hydraulic circuit is reversed, high pressure fluid in bores 511 and 541 is delivered to the second bore of the inner section, with low pressure fluid returned through bores 542 and 510.

It will be appreciated by one skilled in the art that shuttle valve embodiments described with respect of FIGS. 16 and 17 may be modified to incorporate the pressure dump functionality of valve module 300 (i.e. means for short-circuiting the dual bores and/or venting pressure to the wellbore annulus). In one implementation, this can be achieved by providing a sleeve with an additional annular recess and a third axial position which provides connection of radial ports fluidly connected to the first and second bores of the inner rod. Alternatively, a secondary shear out sleeve may be incorporated in the valve module sleeve, such that an overpull on the valve module opens communicating radial ports and vents to the exterior of the module.

Variations and modifications to the above-described embodiments are within the scope of the invention. For example, although the described embodiments have first and second axially oriented bores in the rod sections which are substantially parallel to one another, and displaced from one another in a radial direction, other bore arrangements are within the scope of the invention. For example, the both bores may be offset from the central axis of the rod sections. Alternatively, one or both of the bores may define an annular flow channel, which may be formed around a central axis of a rod of the piston element.

In the foregoing embodiments of the invention, the actuator devices are operable in forward and reverse modes, and are reconfigured between the two modes at surface, between downhole operations. Alternative embodiments of the invention are operable to reconfigured when in a downhole location. For example, a mechanism may be provided in the tool to reorient a flow-direction valve such as the valve assemblies 300, 400, or 500 when in situ in the wellbore. Such a mechanism may be actuated electrically, and may for example include a downhole electric motor which effects a relative movement of two sub-assemblies by rotation or axial shifting. Alternatively, the mechanism may be actuated by a mechanical force such as a two (or multi)-stage overpull, one stage of which reorients a flow direction valve (subsequent overpull stages may effect movement of a component of the device to a pressure release condition). Alternatively, or in addition, the mechanism may comprise one or more electronically actuated components such as solenoids which are operable to release one two components of the device and enable reorienting of the flow direction valve by a mechanically and/or electrically applied force. In any case, the reconfiguration of the device may be enacted remotely, from surface, without a requirement to pull the tool from hole for reconfiguration at surface.

The foregoing description relates predominantly to applications to setting and releasing of a downhole plug or packer. However, other applications are within the scope of the invention and include the setting of straddles, whipstocks, and/or cement retainers. The invention facilitates application to advanced sealing technologies such as those which deform or expand tubular components to form metal-to-metal or hybrid metal-elastomer plugs or seals (and which may require relatively large setting and releasing forces).

Other downhole actuation applications are also within the scope of the invention. For example, tubing punch and/or tubing cut tools are facilitated by the bidirectional nature of the actuator device and its flexible output force.

The invention provides an actuator assembly for a downhole tool and a method of use. The actuator assembly comprises an actuator device, which includes a housing and a piston element movable with respect to the housing. First and second fluid paths are configured to couple first and second sides of the piston element to at least one source of fluid pressure in a drive module, and an actuator member is configured to be coupled to a downhole device. The actuator member is movable between a first position and a second position to operate the downhole device in response to a force acting on the piston element. The actuator assembly comprises a pressure release mechanism which is operable to equalise pressure between the first and second fluid paths of the actuator device. The invention may be used in conjunction with a valve module which includes the pressure release mechanism, and the valve member preferably comprises a forward flow position, in which a first side of the piston element is pressurised to urge the piston element in a first direction, and a reverse flow position in which a second side of the piston element is pressurised to urge the piston element in a second direction, opposite the first direction. A preferred embodiment of the invention is setting tool incorporating the actuator assembly.

Embodiments of the invention comprise a modular system of actuator devices, and embodiments are capable of utilisation with a wide range of drive modules, including gas drive modules, downhole pump-motor drive modules, surface pump modules, and hydrostatic drive modules.

The invention obviates or mitigates one or more drawbacks or disadvantages of prior art actuator devices and setting tools. The actuator device or actuator assembly which is capable of releasing a setting force or setting pressure, and which may facilitate the removal of a setting tool from a partially set plug or packer. The actuator systems of the invention are bidirectional or reversible, increasing flexibility of operation, reducing required tool inventory, and avoiding the requirement for a hydraulic reservoir which may increase the required tool length. Actuators of the present invention are modular or stackable, and which enables force output and/or operating pressure to be modified according to application and/or the drive module or methodology employed. Actuators are also suitable for use with a wide range of drive modules.

Various modifications to the above-described embodiments may be made within the scope of the invention, and the invention extends to combinations of features other than those expressly claimed herein.

The invention claimed is:

1. An actuator assembly for a downhole tool, the actuator assembly comprising:

an actuator device comprising:

a housing;

a piston element movable with respect to the housing;

first and second fluid paths configured to couple first and second sides of the piston element to at least one source of fluid pressure;

an actuator member configured to be coupled to a downhole device, the actuator member movable between a first position and a second position to operate the downhole device in response to a force acting on the piston element;

and a pressure release mechanism, wherein the pressure release mechanism is operable to equalize pressure between the first and second fluid paths of the actuator device;

wherein the actuator device comprises a substantially tubular outer housing comprising an internal volume defining at least one hydraulic fluid chamber, and an inner rod extending through the outer housing and sealed with the outer housing at first and second ends of the outer housing.

2. The actuator assembly according to claim 1, wherein the pressure release mechanism is operable to vent internal pressure in the actuator device.

3. The actuator assembly according to claim 1, wherein the pressure release mechanism is operable to move between a first position in which the first and second fluid paths are isolated from one another and in communication with first and second sides of the piston element, and a second position in which the first and second fluid paths are in fluid communication with one another.

4. The actuator assembly according to claim 1, wherein the pressure release mechanism is actuable from surface by imparting a mechanical force on the pressure release mechanism.

5. The actuator assembly according to claim 1, wherein the pressure release mechanism is operable at one or more positions in the movement range of the actuator member between its first position and its second position.

6. The actuator assembly according to claim 1, wherein the pressure release mechanism is implemented in a valve module.

7. The actuator assembly according to claim 6, wherein the valve module comprises a first sub assembly and a second sub assembly, and wherein the first sub assembly and second sub assembly are moveable between a first position in which the first and second fluid paths are isolated from one another and in communication with first and second sides of the piston element, and a second position in which the first and second fluid paths are in fluid communication with one another.

8. The actuator assembly according to claim 7, wherein prior to actuation, the first and second sub assemblies are retained in the first position by a releasable connection.

9. The actuator assembly according to claim 1, comprising a first mode of operation in which a first side of the piston element is pressurized to urge the piston element in a first direction, and a second mode of operation in which a second side of the piston element is pressurized to urge piston element in a second direction, opposite the first direction.

10. The actuator assembly according to claim 1, wherein the inner rod comprises a first bore in communication with the internal volume on a first side of the piston element, and a second bore in communication with the internal volume on a second opposing side of the piston element.

11. The actuator assembly according to claim 10, wherein each of the first and second fluid bores extend through an inner rod of a piston element, and each comprises first and second openings positioned respectively in first and/or second end faces of the inner rod.

12. The actuator assembly according to claim 1, wherein the outer housing is pressure-balanced in use.

13. The actuator assembly according to claim 1, comprising a flow direction means having a forward flow position in which a first side of the piston element is pressurized to urge the piston element in a first direction, and a reverse flow position in which a second side of the piston element is pressurized to urge the piston element in a second direction, opposite the first direction.

14. The actuator assembly according to claim 13, wherein the flow direction means comprises an inlet for receiving pressurized fluid from a drive module, and a return line for receiving fluid returned from the actuator device.

15. The actuator assembly according to claim 13, wherein the flow direction means is operable to be moved between its forward flow and reverse flow positions.

16. The actuator assembly according to claim 15, wherein the flow direction means is operable to be rotated with respect to the actuator device to move between its forward flow and reverse flow positions.

17. The actuator assembly according to claim 15, wherein the flow direction means is operable to slide with respect to the actuator device to move between its forward flow and reverse flow positions.

18. The actuator assembly according to claim 15, wherein the flow direction means operable to be moved between its forward flow and reverse flow positions when in a downhole location.

19. The actuator assembly according to claim 13, wherein the flow direction means is operable to be reconfigured between its forward flow and reverse flow positions when at surface.

20. The actuator assembly according to claim 13, wherein the flow direction means is implemented in a valve module, wherein the valve module comprises a first sub assembly and a second sub assembly, and wherein the valve module is provided with an alignment mechanism which engages the first and/or second sub assemblies when in a desired relative alignment.

21. The actuator assembly according to claim 1, wherein the actuator device comprises at least two actuator modules connected together to assemble the actuator device, wherein each actuator module comprises a piston element and a housing.

22. The actuator assembly according to claim 1, configured to actuate the setting and/or releasing of a plug, a seal, a flow restriction, a support structure, or an anchor in a wellbore.

23. The actuator assembly according to claim 1, configured for use with at least one drive module selected from the group consisting of: a downhole motor-pump drive module; a downhole gas drive module; a surface driven pump drive module; a hydrostatic pressure drive module.

24. A downhole tool comprising:

a drive module; and an actuator assembly according to claim 1.

25. The downhole tool according to claim 24, wherein the downhole tool is a setting tool.

26. A downhole assembly comprising a setting tool according to claim 25, and a downhole apparatus connected to the setting tool, wherein the downhole apparatus functions to form a plug, a seal, a flow restriction, a support structure, or an anchor in a wellbore.

27. The downhole assembly according to claim 26, wherein the downhole apparatus comprises one or more segments defining an extendable structure at least partially formed from a metal tubular.

28. The actuator assembly according to claim 1, wherein the actuator device is operable to pressurize the first side of the piston element via the first fluid path to urge the piston element in a first direction and thereby move the actuator member between the first position and the second position.

29. The actuator assembly according to claim 1, further comprising a second mode of operation in which the second side of the piston element is pressurized to urge the piston element in a second direction, opposite the first direction.

30. A method of operating an actuator device of a downhole tool, the method comprising:

providing the actuator device comprising a substantially tubular outer housing comprising an internal volume defining at least one hydraulic fluid chamber; an inner rod extending through the outer housing and sealed with the outer housing at first and second ends of the outer housing; a piston element, and first and second fluid paths coupled to first and second sides of the piston element to at least one source of fluid pressure; and an actuator member coupled to a downhole device;

the method comprising:

moving the actuator member between a first position and a second position in response to a force acting on the piston element to actuate the downhole device; and operating a pressure release mechanism to equalize pressure between the first and second fluid paths of the actuator device.

31. The method according to claim 30, further comprising venting internal pressure in the actuator device.

32. The method according to claim 30, further comprising moving the pressure release mechanism between a first position in which the first and second fluid paths are isolated from one another and in communication with first and second sides of the piston element, and a second position in which the first and second fluid lines are in fluid communication with one another.

33. The method according to claim 30, further comprising actuating the pressure release mechanism from surface by imparting a mechanical force on the pressure release mechanism.

34. The method according to claim 30, further comprising actuating the pressure release mechanism at a position in the movement range of the actuator member between its first position and its second position.

35. The method according to claim 30, further comprising moving the actuator member by pressurizing a first side of the piston element via the first fluid path, and directing return fluid from the second side of the piston element via the second fluid path.

36. The method according to claim 30, further comprising disconnecting the actuator device from a downhole apparatus.

37. The method according to claim 30, further comprising pressurizing the first side of the piston element via the first fluid path to cause a force to act on the piston element and urge the piston element in a first direction.

* * * * *